US006302504B1

(12) United States Patent
Imanaka et al.

(10) Patent No.: US 6,302,504 B1
(45) Date of Patent: Oct. 16, 2001

(54) RECORDING HEAD AND RECORDING APPARATUS USING THE SAME

(75) Inventors: Yoshiyuki Imanaka, Kawasaki; Masami Kasamoto, Ayase; Tatsuo Furukawa, Isehara; Toshihiro Mori; Teruo Ozaki, both of Yokohama; Hidenori Watanabe, Zama; Muga Mochizuki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/882,035

(22) Filed: Jun. 25, 1997

(30) Foreign Application Priority Data

| | | |
|---|---|---|
| Jun. 26, 1996 | (JP) | 8-166089 |
| Jul. 26, 1996 | (JP) | 8-197241 |
| Aug. 30, 1996 | (JP) | 8-231081 |
| Nov. 12, 1996 | (JP) | 8-300417 |

(51) Int. Cl.[7] ..... B41J 29/38
(52) U.S. Cl. ..... 347/9; 347/12
(58) Field of Search ..... 347/9, 12, 57, 347/237, 59, 50, 63, 64, 19, 23, 14, 20, 112

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,723,129 | | 2/1988 | Endo et al. | 346/1.1 |
| 4,740,796 | | 4/1988 | Endo et al. | 346/1.1 |
| 4,831,395 | * | 5/1988 | Pham et al. | 347/237 |
| 4,947,191 | | 8/1990 | Nozawa et al. | 346/140 R |
| 5,006,867 | | 4/1991 | Koizumi et al. | 346/140 R |
| 5,081,474 | | 1/1992 | Shibata et al. | 346/140 R |
| 5,083,137 | | 1/1992 | Badyal et al. | 346/1.1 |
| 5,175,565 | | 12/1992 | Ishinaga et al. | 346/140 R |
| 5,300,968 | | 4/1994 | Hawkins | 346/140 R |
| 5,479,197 | | 12/1995 | Fujikawa et al. | 347/63 |
| 5,491,505 | | 2/1996 | Suzuki et al. | 347/203 |
| 5,580,468 | | 12/1996 | Fujikawa et al. | 216/27 |
| 5,602,576 | | 2/1997 | Murooka et al. | 347/59 |
| 5,850,242 | * | 3/1996 | Asaba | 347/59 |

FOREIGN PATENT DOCUMENTS

| | | |
|---|---|---|
| 2843064 | 4/1979 | (DE) . |
| 195 01 707 | 6/1996 | (DE) . |
| 0 605 211 | 7/1994 | (EP) . |
| 0 646 461 | 4/1995 | (EP) . |
| 0 690 411 | 1/1996 | (EP) . |
| 54-51834 | 4/1979 | (JP) . |
| 59-123670 | 7/1984 | (JP) . |
| 59-138461 | 8/1984 | (JP) . |
| 59-212283 | 12/1984 | (JP) . |
| 63-174422 | 7/1988 | (JP) . |
| 3-074870 | 3/1991 | (JP) . |
| 5-185594 | 7/1993 | (JP) . |
| 8-156248 | 6/1996 | (JP) . |

OTHER PUBLICATIONS

Millman, Jacob, Microelectronics: Digital and Analog Circuits and Systems, Mc Graw–Hill, Inc, p.233, figures 6–26 and 6–27, 1987.*

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

Upon executing printing by latching an input digital image signal temporarily stored in a shift register (502) by a latch circuit (501), and energizing and driving a heater (401) using a power transistor (410) using an nMOSFET on the basis of the latched image signal, a voltage converter (111) boosts a voltage representing the ON state of the latched digital signal, and applies the boosted voltage to the power transistor (410).

71 Claims, 27 Drawing Sheets

RECORDING HEAD AND RECORDING APPARATUS USING THE SAME

BACKGROUND OF THE INVENTION

The present invention relates to a recording head substrate, a recording head using the recording head substrate, and a recording apparatus using the recording head.

A recording head mounted on a conventional ink-jet recording apparatus has a circuit arrangement, as shown in FIG. 10. In such printing head, electro-thermal conversion elements (heaters) and a driving circuit therefor are formed on a single substrate using the semiconductor process technique, as disclosed in, e.g., Japanese Patent Laid-Open No. 5-185594.

Referring to FIG. 10, reference numeral 401 denotes electro-thermal conversion elements (heaters) for generating heat energy; 451, power transistors each for supplying a desired current to the corresponding heater 401; 502, a shift register for temporarily storing image data indicating whether or not currents are supplied to the individual heaters 401 to eject ink from the nozzles of the recording head; 503, an image data input terminal for serially inputting image data (DATA) for turning on/off the heaters 401; 504, an input terminal provided to the shift register 502 to receive transfer clock pulses (CLK); 501, latch circuits for storing image data (DATA) corresponding to the heaters 401 in units of heaters; 505, a latch signal input terminal for inputting a latch timing signal (LT) to the latch circuits 501; 506, switches for determining the supply timings of currents to the heaters 401; 452, a power supply line for applying a predetermined voltage to the heaters to supply currents; and 453, a GND line into which currents that flowed through the heater 401 and the power transistor 451 flow.

Note that the number of bits of image data stored in the shift register 502, the number of power transistors 451, and the number of heaters 401 are equal to each other.

FIG. 11 is a timing chart of various signals for driving the recording head driving circuit shown in FIG. 10.

The operation of the recording head driving circuit shown in FIG. 10 will be described below with reference to FIG. 11. A number of transfer clock pulses (CLK) corresponding to the number of bits of image data stored in the shift register 502 is input to the transfer clock input terminal 504. In this case, assume that data is transferred to the shift register 502 in synchronism with the leading edge of the transfer clock pulses (CLK), and image data (DATA) for turning on/off the heaters 401 is input from the image data input terminal 503.

Since the number of bits of image data stored in the shift register 502, the number of heaters 401, and the number of power transistors 451 for current driving are equal to each other, transfer clock pulses (CLK) corresponding to the number of heaters 401 are input to transfer the image data (DATA) to the shift register 502. Thereafter, a latch signal (LT) is supplied to the latch signal input terminal 505 to latch image data corresponding to the heaters 401 in the latch circuits 501.

Thereafter, when the switches 506 are set in the "ON" state for an appropriate period of time, currents are supplied to the power transistors 451 and heaters 401 via the power supply line 451 in correspondence with the ON durations of the switches 506, and the currents then flow into the GND line 453. At this time, each heater 401 generates heat required for ejecting ink, and ink corresponding to the image data (DATA) is ejected from the nozzles of the recording head.

The above-mentioned arrangement is conventionally known. Furthermore, a recording head having an arrangement shown in FIG. 12, as an improved arrangement of FIG. 10, is also proposed.

Referring to FIG. 12, reference numeral 410 denotes nMOS field effect transistors (FETs) serving as power transistors for supplying desired currents to the heaters.

When this circuit arrangement is compared with that shown in FIG. 10, the arrangement shown in FIG. 10 uses Darlington-connected npn transistors as each power transistor. In this arrangement, a logic circuit such as a shift register, a latch, or the like normally uses a CMOS gate, and a BiCMOS process is used to form npn transistors simultaneously with such gate. However, the BiCMOS process requires a large number of masks, and results in high cost. In view of this problem, as shown in FIG. 12, when nMOS transistors are used in place of npn transistors, the power transistors can be formed using the same process (CMOS process) as that of the logic circuit, thus allowing the manufacture of a recording head with relatively low cost.

An ink-jet printing method (i.e., a printing method by ejecting liquid) can realize high speed printing and has negligibly small noise produced upon printing, and has received a lot of attention recently since it can attain printing without requiring any special process, i.e., a so-called fixing process to a normal paper sheet.

Among such ink-jet printing methods, the liquid-jet printing methods described in, e.g., Japanese Patent Laid-Open No. 54-51834 and DOLS No. 2843064 have features different from other liquid-jet printing methods in that they acquire a driving force for ejecting a droplet by applying heat energy to the liquid.

More specifically, the printing method disclosed in the above references is characterized in that the liquid that received the applied heat energy undergoes changes in state accompanying an abrupt increase in volume and is ejected by an effect obtained based on the changes in state from each orifice at the distal end of a recording head to form a flying droplet, and the droplet becomes attached to a printing medium to attain recording.

Especially, the liquid-jet printing method disclosed in DOLS No. 2843064 is very effectively applied to a so-called drop-on demand printing method, and can easily realize a full-line type, high-density, multi-orifice recording head. For this reason, high-speed printing of a high-resolution, high-quality image can be achieved.

The recording head that uses the above-mentioned printing method is built by a recording head substrate which comprises liquid ejection portions having orifices formed to eject a liquid, heat applying portions which communicate with the orifices to apply heat energy for ejecting a droplet to the liquid, liquid channels including the heat applying portions, and substrate of recording head including electro-thermal conversion elements (heating elements) as means for generating heat energy.

In recent years, on such substrate, not only a plurality of heating elements are formed, but also logic circuits such as a plurality of drivers for driving the individual heating elements, a shift register for temporarily storing image data having the same number of bits as the number of heating elements to parallelly transfer the image data, serially input from a recording apparatus, to the drivers, latch circuits for temporarily latching data output from the shift register, and the like can be mounted on the single substrate.

FIG. 19 is a block diagram showing the logic circuit arrangement of a conventional recording head having N heating elements (print elements).

Referring to FIG. 19, reference numeral 700 denotes a substrate; 701, heating elements; 702, power transistors; 703, an N-bit latch circuit; and 704, an N-bit shift register. Reference numeral 715 denotes a sensor for monitoring the resistances of the heating elements 701 or the temperature of the substrate 700, or a heater for keeping the substrate 700 at a desired temperature. A plurality of such sensors and heaters may be mounted, and the sensor and heater may be integrally arranged. Reference numerals 705 to 714, and 716 denote input/output pads. Of these input/output pads, reference numeral 705 denotes a clock input pad for inputting clock pulses (CLK) for operating the shift register 704; 706, an image data input pad for serially inputting image data (DATA); 707, a latch input pad for inputting a latch clock pulses (LTCLK) for controlling the latch circuit 703 to latch image data; 708, a driving signal input pad for inputting heat pulses (HEAT) for externally controlling the driving time in which the power transistors 702 are turned on to energize and drive the heating elements 701; 709, a driving power supply input pad for inputting a driving power supply voltage (3 to 8 V, normally, 5 V) for the logic circuits; 710, a GND terminal; 711, a heating element power supply input pad for inputting a power supply voltage for driving the heating elements 701; 712, a reset input pad for inputting a reset signal (RST) for initializing the latch circuit 703 and the shift register 704; and 713, a terminal for a heating element driving power supply.

Reference numerals 714-(1) to 714-(n) denote output pads for monitoring signals and input pads for control signals for driving the sensor and the temperature control heater. Furthermore, reference numerals 716-(1) to 716-(n) denote block selection input pads for inputting block selection signals (BLK1, BLK2, . . . , BLKn) for selecting a block when the N heating elements are divided into n blocks, and the n blocks are to be time-divisionally driven. Reference numeral 717 denotes AND gates for logically ANDing the outputs from the latch circuit 702, the heat signals (HEAT), and the block selection signals (BLK1, BLK2,. . . , BLKn).

The driving sequence of the recording head with the above arrangement is as follows. Note that image data (DATA) is binary data which is defined by one bit per pixel.

When a recording apparatus main body to which the recording head is attached serially outputs image data (DATA) in synchronism with clock pulses (CLK), the output data is input to the shift register 704. The input image data (DATA) is temporarily stored in the latch circuit 703, which generates ON/OFF outputs corresponding to the value ("0" or "1" ) of image data.

In this state, when the heat pulse (HEAT) and the block selection signal are input, the latch circuit 703 supplies ON outputs, and the power transistors corresponding to the heating elements selected as a block by the block selection signal are driven during the ON time of the input heat pulse (HEAT), thus supplying currents to the corresponding heating elements to execute printing.

In the logic circuit of the recording head shown in FIG. 19, the power transistors 702 comprise npn bipolar transistors, and the logic circuit is formed using a BiCMOS process. However, in some cases, using MOSFETs as the power transistors, the logic circuit may be formed using the CMOS process as the manufacturing process in lieu of the BiCMOS process. With this process, not only the number of steps in the manufacturing process can be reduced, but also the space required for element isolation can be reduced, thus achieving a size reduction of the substrate.

This will be explained in more detail below with reference to FIGS. 20A to 22D.

FIGS. 20A and 20B are logic circuit diagrams showing a power transistor for driving a single heating element when the power transistor uses bipolar transistors. FIG. 20A is an equivalent circuit diagram of a circuit using two npn bipolar transistors 702*a* and 702*b*, and FIG. 20B is a sectional view of the substrate. Referring to FIG. 20A, a logic output 721 corresponds to the output from the AND gate 717. FIG. 20B shows how to form n-type regions 723, 725, 726, and 727, and p-type regions 724, 728, and 729 on the substrate so as to construct the npn bipolar transistor. Also, in FIG. 20B, symbols B, E, and C respectively denote the base, emitter, and collector.

FIGS. 21A to 21D are respectively a circuit diagram and sectional views of a substrate when the power transistor uses a MOSFET, and the entire logic circuit is formed by the CMOS process.

FIG. 21A is an equivalent circuit diagram of a circuit used when the power transistor for driving a single heating element uses an nMOS 720, FIG. 21B is a sectional view of the substrate that makes up the circuit shown in FIG. 21A, and FIGS. 21C and 21D are sectional views of substrates that form nMOS and pMOS transistors used in logic circuits such as the latch circuit 703, the shift register 704, and the like. In FIGS. 21B to 21D, symbols S, G, and D respectively denote the source, gate, and drain; 731, 732, and 736, n-type regions; and 733 to 735, p-type regions.

When the power transistor uses a MOSFET, the entire logic circuit can be formed by a CMOS process, and the necessity of $n^+$-type regions 726 and 727 for the collector, n-type epitaxial layer 725, p-type element isolation region 729, and the like (FIG. 20B), which are required in the BiCMOS process in addition to CMOS circuits including the nMOS transistors (FIG. 21C) and pMOS transistors (FIG. 21D) that form the logic circuit, can be obviated.

As a MOS power transistor, an nMOS transistor is popularly used owing to its specific electron mobility, and the like. When the nMOS transistor is used in the logic circuit of the ink-jet recording head, a voltage of 20 V or higher is applied to the drain (D) of the power transistor which is not driven. In consideration of such voltage, in order to assure such breakdown voltage, it is a common practice to form an $n^{31}$ -type region in the drain region (offset type MOS transistor), as shown in FIG. 21B.

SUMMARY OF THE INVENTION

However, in the conventional CMOS logic circuit, a digital signal which has 0 V/5 V as its Low/Hi level is normally used as a signal, and the output from the latch circuit 501 shown in FIG. 12 does not exceed 5 V when its signal level is "Hi". Hence, a high voltage of 5 V or higher cannot be applied as the gate voltage of the power transistor 502. On the other hand, the nMOS transistor normally has the current-voltage characteristics, as shown in FIG. 13. That is, if the gate voltage (VG) is raised, the maximum value of the current (drain-source current: IDS) that can be supplied increases accordingly, and the operation point of the drain voltage (drain-source voltage: VDS) at that time lowers. More specifically, the drivability of the nMOS transistor is improved as the gate voltage (VG) is higher.

For this reason, since the gate voltage of the power transistor using the nMOS transistor is defined by 5 V as the signal amplitude in the CMOS logic circuit in the recording head built by the CMOS logic circuits and power transistors using nMOS transistors, drivability that can fully use the characteristics of the nMOS transistors cannot be sufficiently obtained.

The present invention has been made in consideration of the above-mentioned prior art, and has as its object to provide a recording head which adopts a power transistor using, e.g., an nMOS transistor, and can improve the drivability of the nMOS transistor, and a recording apparatus using the recording head.

In order to achieve the above object, a recording head according to the present invention comprises the following arrangement.

That is, a recording head comprises a heater, a power transistor for driving the heater, a logic circuit for driving the power transistors, and a voltage converter for converting the voltage amplitude of a signal output from the logic circuit into a higher voltage amplitude, and applying the signal with the converted amplitude to the gate electrode of the power transistor.

With this arrangement, upon driving the heater by inputting a logic circuit output corresponding to a digital signal, which respectively expresses OFF and ON by 0 V and 5 V, to the power transistor, e.g., a FET, the output can be boosted and applied to the power transistor.

Such power supply conversion circuit is inserted between the output of a latch circuit and the gate of the power transistor such as a FET, and supplies a voltage with an amplitude higher than the digital signal amplitude of 0 V/5 V to the gate of the power transistor.

Note that the recording head can use a recording head that performs printing in accordance with an ink-jet method.

According to another invention, a recording apparatus uses the recording head with the above arrangement.

On the other hand, as shown in FIG. 12, a recording head, which uses a MOS transistor as a power transistor, cannot often operate desirably due to variations in the manufacturing process. Such problem will be explained below with reference to the graph showing the current-voltage characteristics of an nMOS transistor in FIG. 15. FIG. 15 shows the static characteristic curve of the nMOS transistor, and the load curve due to the resistance of the heater of the recording head.

When a recording head shown in FIG. 14 is mounted on a recording apparatus, and executes printing by ejecting ink, an nMOS transistor is turned on, and supplies a current to the corresponding heater. At this time, a voltage (VOP) which is applied across the drain-source path of the nMOS transistor and a current (IOP) that flows through the drain-source path correspond to the intersection (operation point) between the static characteristic curve of the nMOS transistor and the load curve due to the heater resistance. If VH represents the voltage to be applied to the heater, energy generated by the heater upon ejecting ink is (VH−VOP)×IOP.

On the other hand, in a recording head according to the ink-jet method, the drain-source voltage (VOP) upon ejecting ink preferably assumes a small value to improve electrothermal conversion efficiency. For this purpose, the nMOS transistor is preferably designated to operate in a triode region at the operation point of the nMOS transistor. The relationship between the drain current (IDS) and the drain-source voltage (VDS) at that time is given by equation (1) below:

$$IDS=(W/L)\cdot\mu n\cdot COX[(VG-VTH)\cdot VDS-(1/2)VDS^2] \quad (1)$$

where W: gate width, L: gate length, $\mu$n: electron mobility, COX: thickness of a gate oxide film, VG: gate voltage, and VTH: threshold voltage.

As is known, among the causes that drift the characteristics of the nMOS transistor, process variations in gate length (L) have the most serious influence. For example, when an nMOS transistor having a gate length (L, $\mu$m) that satisfies $3 \leqq L$ is manufactured, it is a common practice to use a mirror projection aligner (MPA) in the manufacture of the transistor. However, this aligner may produce maximum process variations of ±1.0 $\mu$m with respect to the design value (L0).

As can be seen from equation (1), since the gate length (L) is inversely proportional to the drain current (IDS), and the rate of change in size due to the process variations with respect to the design value (L0) is large, the static characteristics of the nMOS transistor are seriously influenced. In FIG. 15, the broken curve represents the static characteristics when the gate length (L) becomes larger than the design value (L0), and the dotted curve represents the static characteristics when the gate length (L) becomes smaller than the design value (L0).

According to such changes in characteristics, when the gate length (L) becomes larger than the design value (L0) (L>L0), both the voltage applied from the nMOS transistor to the header and the current supplied to the heater decrease, and energy generated by the heater is reduced. Conversely, when the gate length (L) becomes smaller than the design value (L0) (L<L0), the driving force of the nMOS transistor is improved, and both the voltage applied to the heater and the current supplied to the heater increase, thus increasing energy generated by the heater.

Hence, when the energy generated by the heater becomes larger than the design value, ink is not ejected; conversely, when the energy generated by the heater is smaller than the design value, ink scorches on the heater or the service life of the heater is shortened. In this manner, the driving force of the nMOS transistor changes depending on variations in the manufacturing process of the recording head, and as a result, such changes have serious influences on the printing operation and service life of the recording head.

It is an object of the present invention to provide an ink-jet recording head, which adopts an MOS transistor in a driving circuit, and can normally operate even when the characteristics of the MOS transistor change due to variations in the manufacturing process, and a recording apparatus using the recording head.

In order to achieve the above object, a recording head of the present invention has the following arrangement.

More specifically, a recording head comprises a heater, a power transistor for driving the heater, a logic circuit for driving the power transistor, a voltage converter for converting the voltage amplitude of a signal output from the logic circuit into a higher voltage amplitude, and applying the signal with the converted amplitude to the gate electrode of the power transistor, and a correction circuit for correcting characteristic variations of the power transistor.

Note that variations in gate length of a MOS transistor as a power transistor in the semiconductor manufacturing process are included in factors of characteristic variations. The correction circuit controls the gate voltage of the MOS transistor to compensate for the characteristic variations due to the variations in gate length, thereby suppressing drain current drifts of the MOS transistor. More specifically, when the gate length becomes smaller than the design value due to variations in the semiconductor manufacturing process, the correction circuit controls to lower the gate voltage; when the gate length becomes larger than the design value, the correction circuit controls to raise the gate voltage.

Furthermore, the recording head has a first power supply line for applying a first voltage to the heater, a second power supply line for applying a second voltage to the logic circuit, and a third power supply line for applying a third voltage to the voltage converter, and the correction circuit includes a second resistor as a polysilicon resistor, and a third nMOS transistor connected to the resistor.

Note that one terminal of the second resistor may be connected to the first power supply line, the node between the other terminal of a first resistor and the drain of the third nMOS transistor may be connected to the third power supply line, and the source of the third nMOS transistor may be connected to ground.

Alternatively, the recording head may further have a source-follower circuit consisting of a fourth nMOS transistor, and a third resistor connected between the source of the transistor and ground, the drain of the fourth nMOS transistor may be connected to the first power supply line, the node between the other terminal of the second resistor and the drain of the third nMOS transistor may be connected to the gate of the fourth nMOS transistor, and the node between the source of the fourth nMOS transistor and the third resistor may be connected to the second power supply line.

Note that a driving circuit may be either a circuit formed by a CMOS process or a circuit formed by an nMOS process.

This recording head may be either an ink-jet recording head that performs printing by ejecting ink, or a recording head which ejects ink using heat energy and comprises a heat energy conversion element for generating heat energy to be applied to the ink.

According to another invention, a recording apparatus uses the recording head with the above arrangement.

In addition to the problems associated with driving of the power transistors and the arrangement of gate voltage booster circuits, another problem is posed when the manufacturing process changes from the BiCMOS process to the simple CMOS process. Such problem is posed when a temperature sensor, especially, a diode, is used, and it will be described below with reference to FIG. 22.

As shown in FIG. 22, when a diode has a conventional MOS structure, for example, a ① "$p^+$-type region" serving as a source-drain region 415 of a CMOS logic pMOS must be used as the anode, and a ② "n-type region" serving as a substrate region 416 of the CMOS logic pMOS must be used as the cathode to build the diode. In this case, when a forward current is supplied from the anode to the cathode, since a p-type substrate 414 is present below the ② n-type region 416, a pnp structure is formed here, and a parasitic pnp transistor operates to supply currents to the substrate. Especially, in the case of CMOS, such currents lead to a problem such as latch-up. When two or more diodes with this structure are connected in series for the purpose of increasing the output amplitude of a sensor, averaging sensors at a plurality of points, and the like, even when constant current driving is done, currents are supplied from the first diode to the substrate, and only currents 1/{hFE} of the parasitic transistor are supplied to the second and subsequent diodes. In this manner, it is impossible to attain a series connection of diodes in practice since "the temperature characteristics vary depending on the diode positions, "the influence of variations of the current gain hFE of the transistor, i.e., the semiconductor manufacturing process is serious", and so on.

The present invention has been made in consideration of the above situation, and has as its object to provide a recording head substrate which can form a CMOS inverter circuit, comprising a pMOS or nMOS element that can withstand the driving voltage of a heating element, at the input side of a power transistor, without increasing consumption power, without requiring another power supply, and without causing any voltage drifts, a recording head using the recording head substrate, and a recording apparatus using the recording head.

It is another object of the present invention to provide a recording head substrate, which has a structure in which a $p^-$-type layer or n-type layer is added to the pMOS or nMOS element of the CMOS inverter circuit, so that a diode sensor has an npnp or pnpn structure and is completely isolated from a p- or n-type substrate, and which can realize a series connection of diodes while preventing the influence of a parasitic transistor, a recording head using the recording head substrate, and a recording apparatus using the recording head.

In order to solve the above-mentioned problems and to achieve the above objects, a recording head of the present invention comprises the following arrangement.

a heater corresponding to a print element;

a power transistor for energizing and driving the heater;

a logic circuit for driving the power transistor; and a voltage converter for converting a voltage amplitude of a signal output from the logic circuit to a higher voltage amplitude, and applying the signal with the converted amplitude to the gate electrode of the MOS transistor, the voltage converter including:

a first resistor;

a first nMOS transistor, a drain of which is connected to the first resistor; and a CMOS inverter circuit consisting of a first pMOS transistor and a second nMOS transistor, gates of which are connected between the first resistor and the drain of the first nMOS transistor, and the CMOS inverter circuit having a CMOS inverter circuit having an nMOS element and a pMOS element for determining a voltage to be applied to the gate of the power transistor, and low-concentration regions being formed in drains of the nMOS and pMOS elements.

Also, a recording head of the present invention comprises the following arrangement.

a heater corresponding to a print element;

a power transistor for energizing and driving the heater;

a logic circuit for driving the power transistor; and a voltage converter for converting a voltage amplitude of a signal output from the logic circuit to a higher voltage amplitude, and applying the signal with the converted amplitude to the gate electrode of the MOS transistor, the voltage converter including:

a first resistor;

a first nMOS transistor, a drain of which is connected to the first resistor; and a CMOS inverter circuit consisting of a first pMOS transistor and a second nMOS transistor, gates of which are connected between the first resistor and the drain of the first nMOS transistor, and the CMOS logic circuit having a CMOS inverter circuit having an nMOS element and a pMOS element for determining a voltage to be applied to the gate of the power transistor, and low-concentration regions being formed in drains of the nMOS and pMOS elements.

A recording head of the present invention uses the recording head substrate.

A recording apparatus of the present invention mounts the recording head.

In the above-mentioned prior art, when a MOSFET is used as each power transistor serving as a driving circuit of a recording head, the following problems remain unsolved.

① When switching is done while a voltage of 25 V or higher is applied across the drain-source path of an nMOS serving as a power transistor, an impact ionization phenomenon occurs. That is, electrons as carriers are accelerated by a high voltage in the drain-source path at the instance of turning off the nMOS, and collide against Si atoms to generate ions. These ions readily generate a large leakage current in the drain-source path. If this phenomenon occurs, the entire substrate may be destroyed.

② When the heating element is not driven, the potential difference between the heating element, and the substrate, i.e., the substrate surface contacting ink, silicon (Si) that makes up the substrate, and the like adversely influences the service life of the recording head. More specifically, in the case of a substrate which mounts an nMOS that drives the heating element, elements are generally formed on a p-type silicon (Si) substrate. In this case, the p-type substrate portion serves as GND, while ink reaches the side portions of the substrate and is electrically short-circuited with the substrate. Since ink has conductivity, the ink always serves as GND. Under such condition, in the OFF state of the nMOS, most substrate portion that contacts the ink as well as the heating element is set at a power supply voltage (VH) for driving the heating element via a protection insulating film. While the recording head and the recording apparatus that mounts the head are in the ON state, the actual energization time of the heating element is very short and no printing is made during the remaining time period with the power supply voltage being kept applied. Hence, an electric field is kept generated in the ink and the substrate surface for a very long period of time, and shortens the service life of the protection insulating film, that is, the service life of the recording head is shortened.

The present invention has been made in consideration of the above-mentioned prior art, and has as its object to provide a recording head which has a simple circuit arrangement and high reliability, and can assure long service life, and a recording apparatus using the recording head.

In order to achieve the above object, a recording head according to the present invention comprises the following arrangement.

a heater corresponding to a print element;

a power transistor for energizing and driving the heater;

a logic circuit for driving the power transistor; and a voltage converter for converting a voltage amplitude of a signal output from the logic circuit to a higher voltage amplitude, and applying the signal with the converted amplitude to the gate electrode of the MOS transistor, the power transistor comprising a pMOS transistor, and the voltage converter having an inverter including at least one nMOS transistor which boosts the voltage to be applied by receiving a print signal output from the logic circuit, and outputs the voltage to the gate of the pMOS transistor, and the pMOS transistor and the heater being serially connected between a power supply line of the heater and ground return from the power supply line side.

According to another invention, a recording apparatus uses the recording head with the above arrangement.

In the recording head with the above arrangement, the pMOS transistor and nMOS transistor may use offset type transistors.

The pMOS transistor and nMOS transistor may be driven by a predetermined power supply voltage, and the heating element, pMOS transistor, and nMOS transistor are formed on a p-type silicon substrate.

Furthermore, the inverter may include a resistor connected between the nMOS transistor and a power supply voltage terminal.

The above-mentioned recording head is suitably applied to an ink-jet recording head that prints by ejecting ink. The ink contacts the heating element via an electrical insulating layer, and is heated by the heating element during printing.

DETAILED DESCRIPTION OF THE PREFERRED EMBODIMENTS

The preferred embodiments of the present invention will be described in detail hereinafter with reference to the accompanying drawings.

Ink-jet Recording Apparatus Main Body

Figure 1:
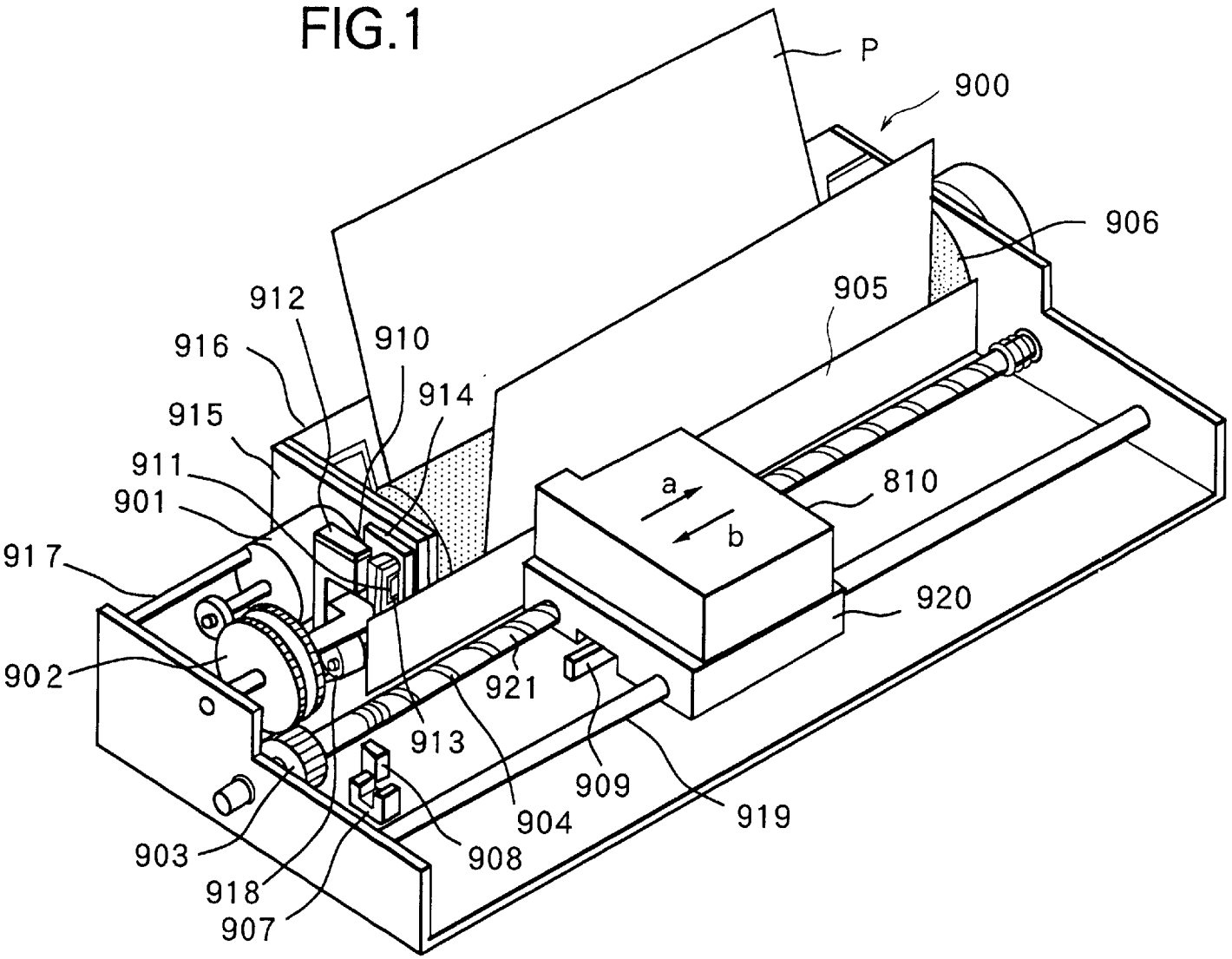
FIG. 1 is a perspective view showing the outer appearance of one mode of an ink-jet recording apparatus main body according to an embodiment of the present invention.

An ink-jet recording apparatus of this embodiment will be described below. FIG. 1 is a perspective view showing the outer appearance of an ink-jet recording apparatus 900 according to an embodiment of the present invention.

Referring to FIG. 1, a recording head 810 is mounted on a carriage 920 which engages with a spiral groove 921 of a lead screw 904, which rotates via driving force transmission gears 902 and 903 in accordance with the forward/reverse rotation of a driving motor 901. The recording head 810 is reciprocally movable in the direction of an arrow a or b along a guide 919 together with the carriage 920 by the driving force of the driving motor 901. A paper press plate 905 for a print paper sheet P which is fed onto a platen 906 from a print medium feeder (not shown) presses the print paper sheet against the platen 906 along the carriage moving direction.

Photocouplers 907 and 908 comprises a home position detection means which confirms the presence of a lever 909 provided to the carriage 920 in the region of the photocouplers 907 and 908 and performs switching of the rotation direction of the driving motor 901, and the like. A support member 910 supports a cap member 911 that caps the surface of the recording head 810, and a suction means 912 draws the interior of the cap member 911 by suction to attain suction recovery of the recording head 810 via an intra-cap opening 513. A moving member 915 allows a cleaning blade 914 to be movable in the back-and-forth direction in FIG. 1, and the cleaning blade 914 and the moving member 915 are supported by a main body support plate 916. The cleaning blade 914 is not limited to the illustrated one, but a known cleaning blade may be applied to this embodiment, needless to say. A lever 917 is arranged to initiate the suction process of the suction recovery, and moves upon movement of a cam 918 which engages with the carriage 920. The movement control of the lever 917 is done by a known transmission means such as clutch switching or the like using the driving force from the driving motor 901. A print controller (not shown) is arranged on the recording apparatus main body side. The print controller supplies a signal to a heating unit 806 formed on the recording head 810, and performs driving control of the individual mechanisms such as the driving motor 901 and the like.

The ink-jet recording apparatus 900 with the above-mentioned arrangement performs printing with respect to the print paper sheet P fed onto the platen 906 from the print medium feeder while the recording head 810 reciprocally moves across the total width of the print paper sheet P. The recording head 810 can perform high-precision, high-speed printing since it is manufactured using an ink-jet recording head substrate having the circuit structure of each of the above-mentioned embodiments.

Arrangement of Control Circuit

Figure 2:
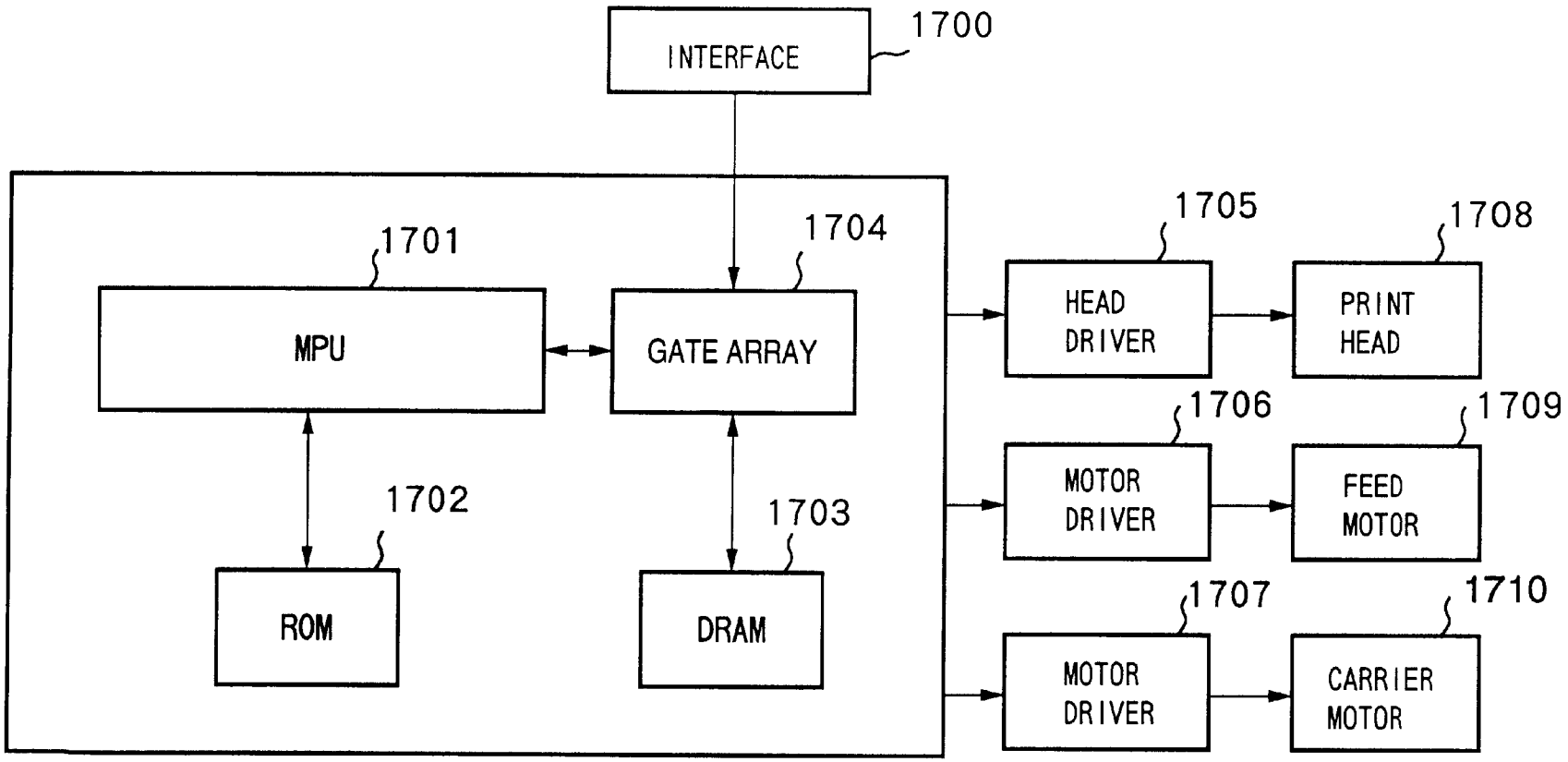
FIG. 2 is a block diagram showing the control circuit arrangement of the ink-jet recording apparatus shown in FIG. 1.

The arrangement of a control circuit for executing the print control of the above-mentioned recording apparatus will be explained below. FIG. 2 is a block diagram showing the arrangement of the control circuit for the ink-jet recording apparatus 900. Referring to FIG. 2 that shows the control circuit, reference numeral 1700 denotes an interface for inputting a print signal; 1701, an MPU; 1702, a program ROM which stores a control program executed by the MPU 1701; and 1703, a dynamic RAM for holding various data (the print signal, print data to be supplied to the head, and the like). Reference numeral 1704 denotes a gate array for executing supply control of print data to a recording head 1708, and also performing data transfer control among the interface 1700, MPU 1701, and RAM 1703. Reference numeral 1710 denotes a carrier motor for conveying the recording head 1708; and 1709, a feed motor for feeding a print paper sheet. Reference numeral 1705 denotes a head driver for driving the head, and 1706 and 1707, motor drivers for respectively driving the feed motor 1709 and the carrier motor 1710.

The operation of the control arrangement will be explained below. When a print signal is input to the interface 1700, the print signal is converted into print data for printing by the gate array 1704 and the MPU 1701. The motor drivers 1706 and 1707 are driven, and the recording head is driven in accordance with the print signal supplied to the head driver 1705, thus attaining printing.

Another Mode of Recording Head

Figure 3:
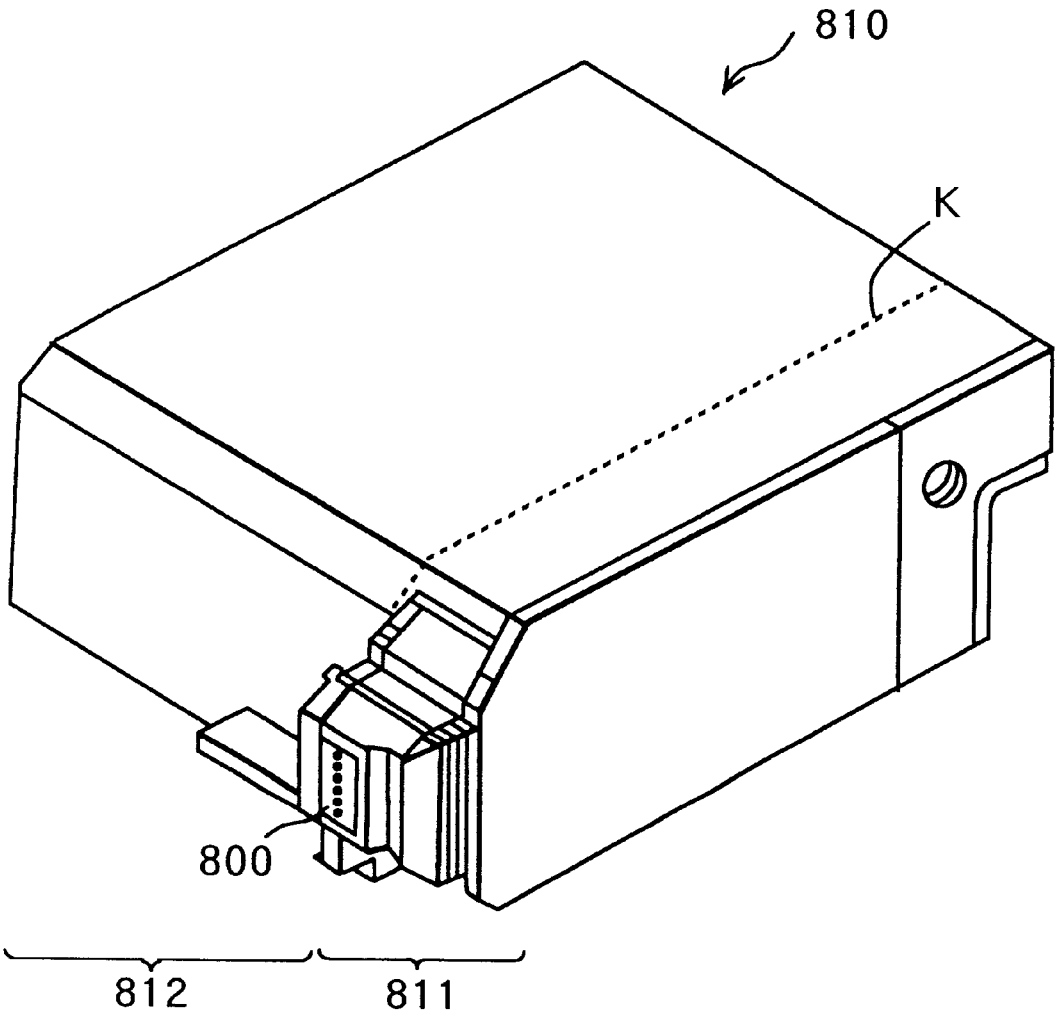
FIG. 3 is a perspective view for explaining another mode of an ink-jet recording head shown in FIG. 1.

As shown in FIG. 3, the ink-jet recording head 810 comprises a recording head unit 811 having a plurality of ejection orifices 800, and an ink tank 812 containing ink to be supplied to the recording head unit 811. The ink tank 812 is detachably attached to the recording head unit 811 to have a boundary line K as a boundary. The ink-jet recording head 810 has electrical contacts (not shown) for receiving electrical signals from the carriage side when it is mounted on the recording apparatus shown in FIG. 1, and heaters are driven by the electrical signals. The ink tank 812 includes a fibrous or porous ink absorber for holding ink, and the ink is held by such ink absorber.

In contrast to this, in the ink-jet recording head 810 shown in FIG. 1, the recording head unit 811 and the ink tank 812 are formed as a single unit.

Ink-jet Recording Head Substrate

Figure 4:
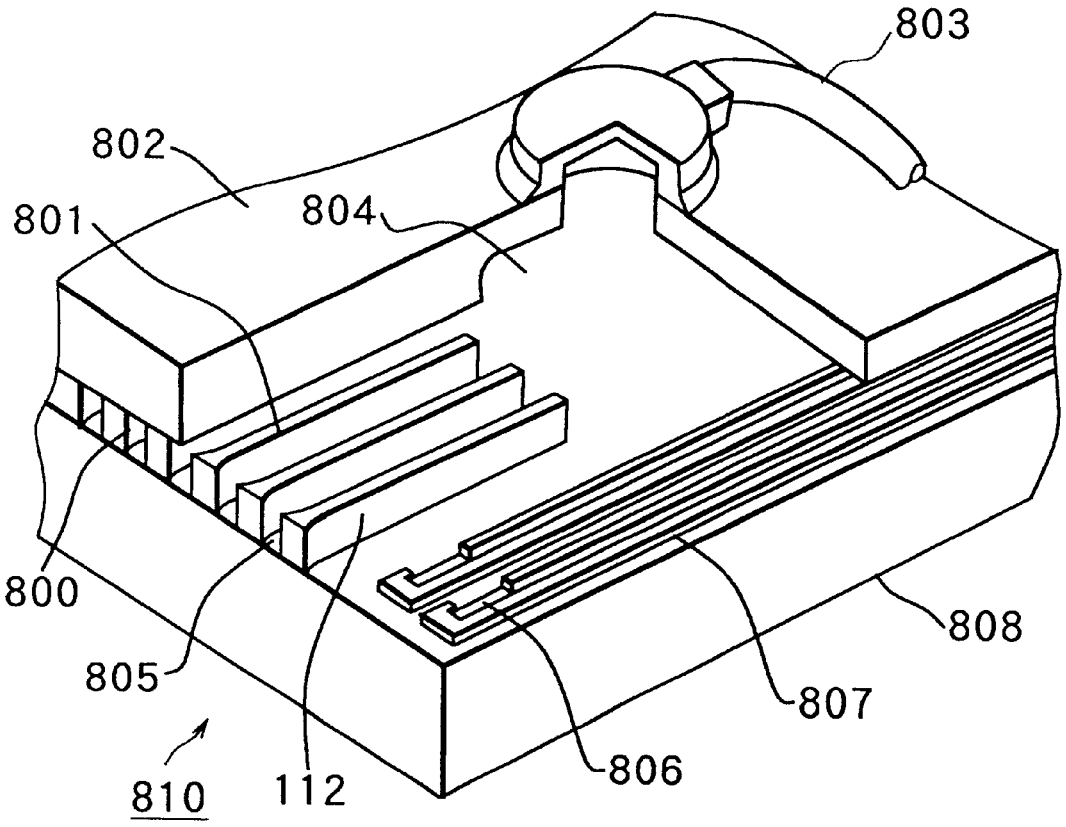
FIG. 4 is a schematic perspective view showing the arrangement of the ink-jet recording head according to an embodiment of the present invention.

The ink-jet recording head substrate of this embodiment will be described below. FIG. 4 is a perspective view showing the arrangement of the ink-jet recording head substrate in detail.

As shown in FIG. 4, the ink-jet recording head substrate can be manufactured with the ink-jet recording head 810 by assembling channel wall members 801 that form ink channels 805 communicating with the plurality of ejection orifices 800, and a top plate grooved member 802 having an ink supply port 803. In this case, the ink injected from the ink supply port 803 is stored in an internal common ink chamber 804 and is supplied to the individual ink channels 805. In this state, by driving a heater 806 connected to a lead 807 on a base 808, ink is ejected from the ejection orifices 800.

When the recording head 810 shown in FIG. 4 is mounted on the ink-jet recording apparatus, and the recording apparatus main body controls signals to be supplied to the recording head 810, an ink-jet recording apparatus which can realize high-speed, high-quality printing can be provided.

Logic Circuit Arrangement of Recording Head

Figure 12:
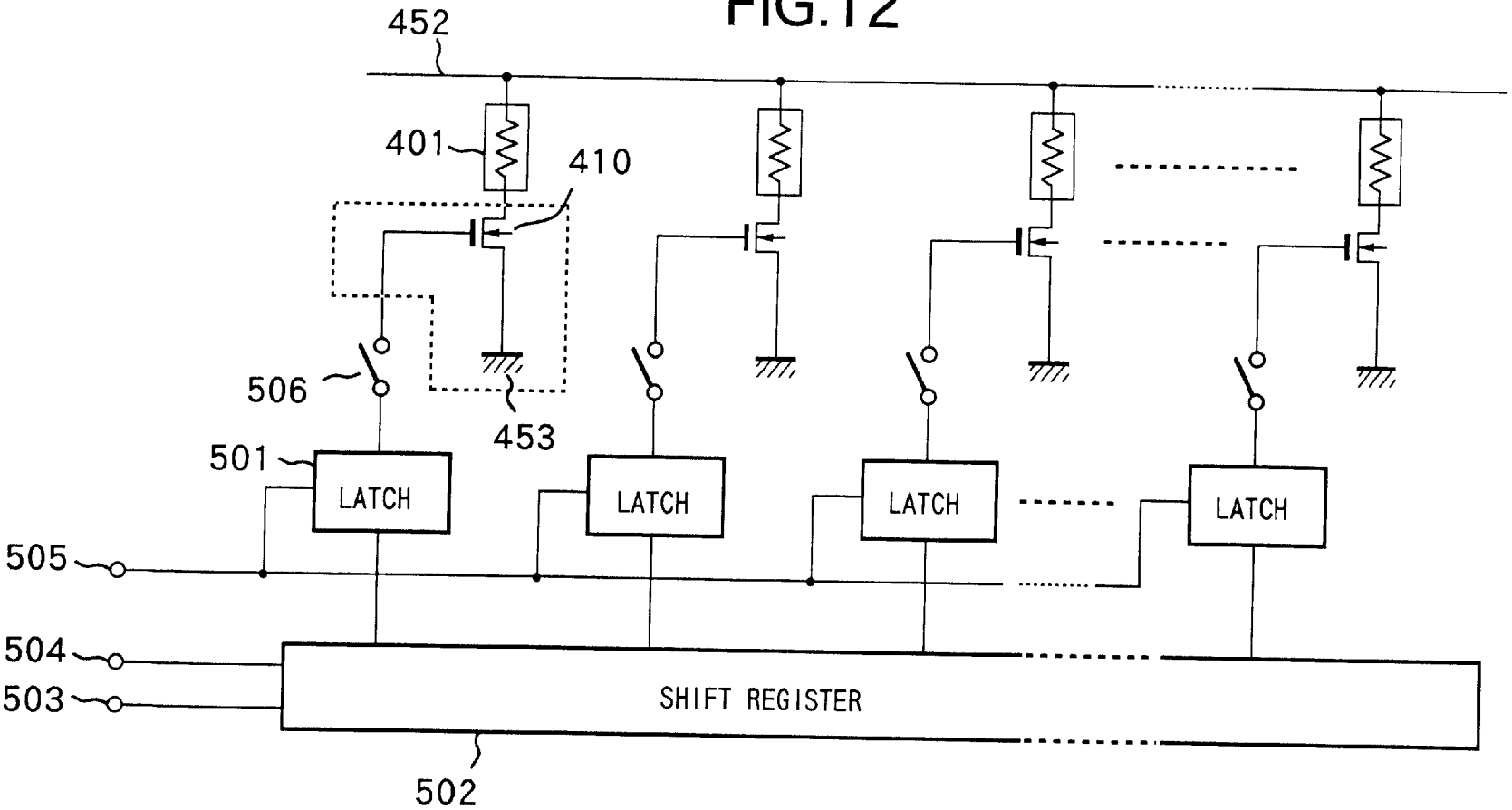
FIG. 12 is a block diagram of the prior art which uses nMOSFETs as power transistors of a recording head.
Figure 13:
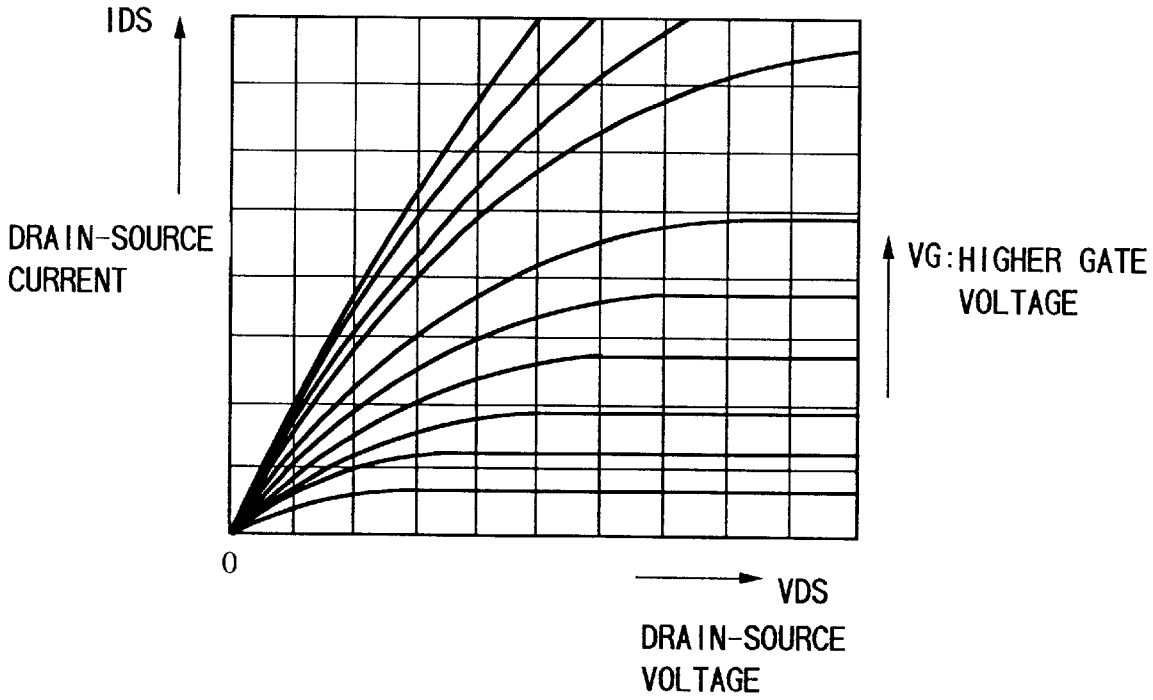
FIG. 13 is a graph showing the VD–ID characteristics of an nMOS transistor.
Figure 14:
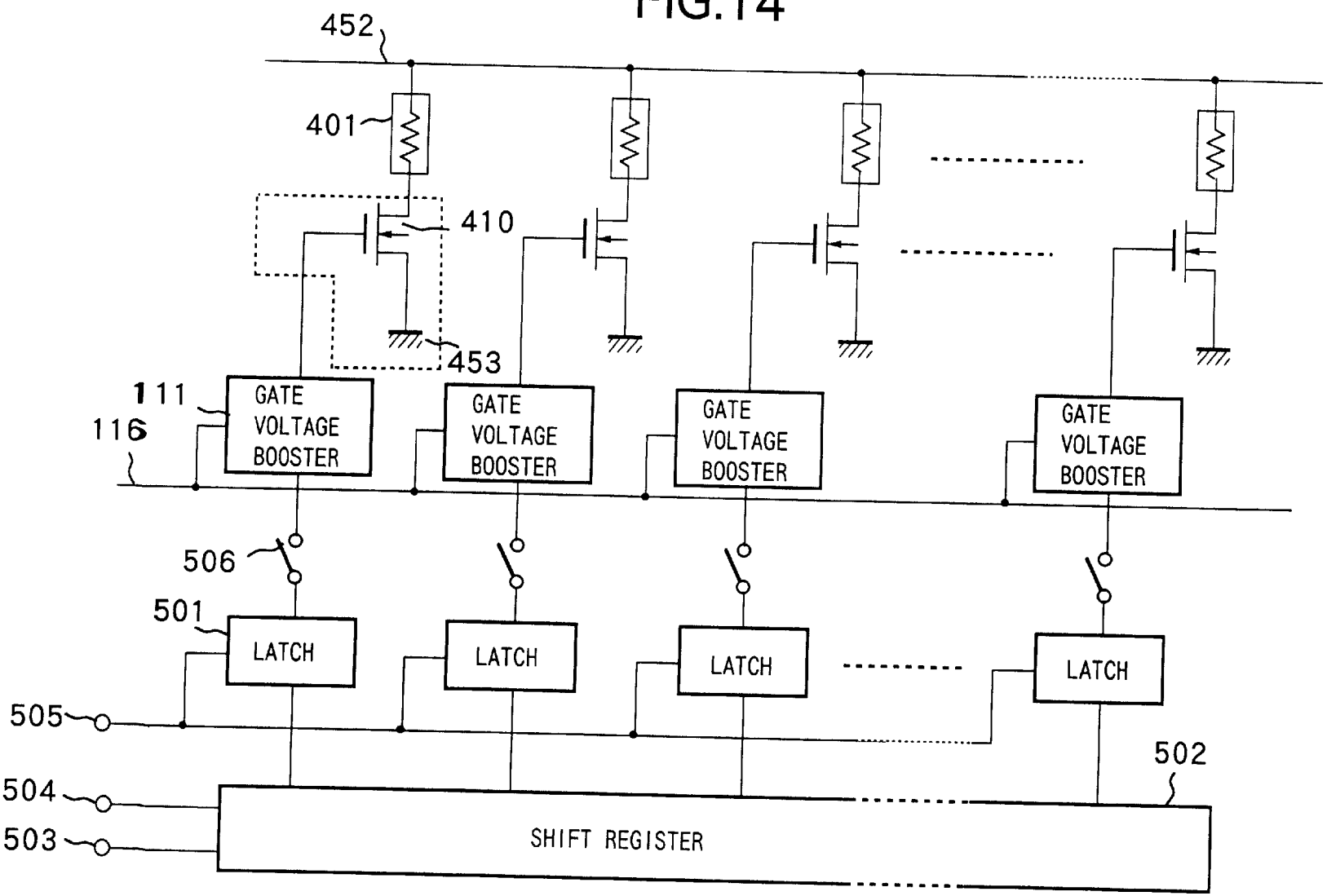
FIG. 14 is a block diagram of the prior art which uses nMOSFETs as power transistors of a recording head.
Figure 15:
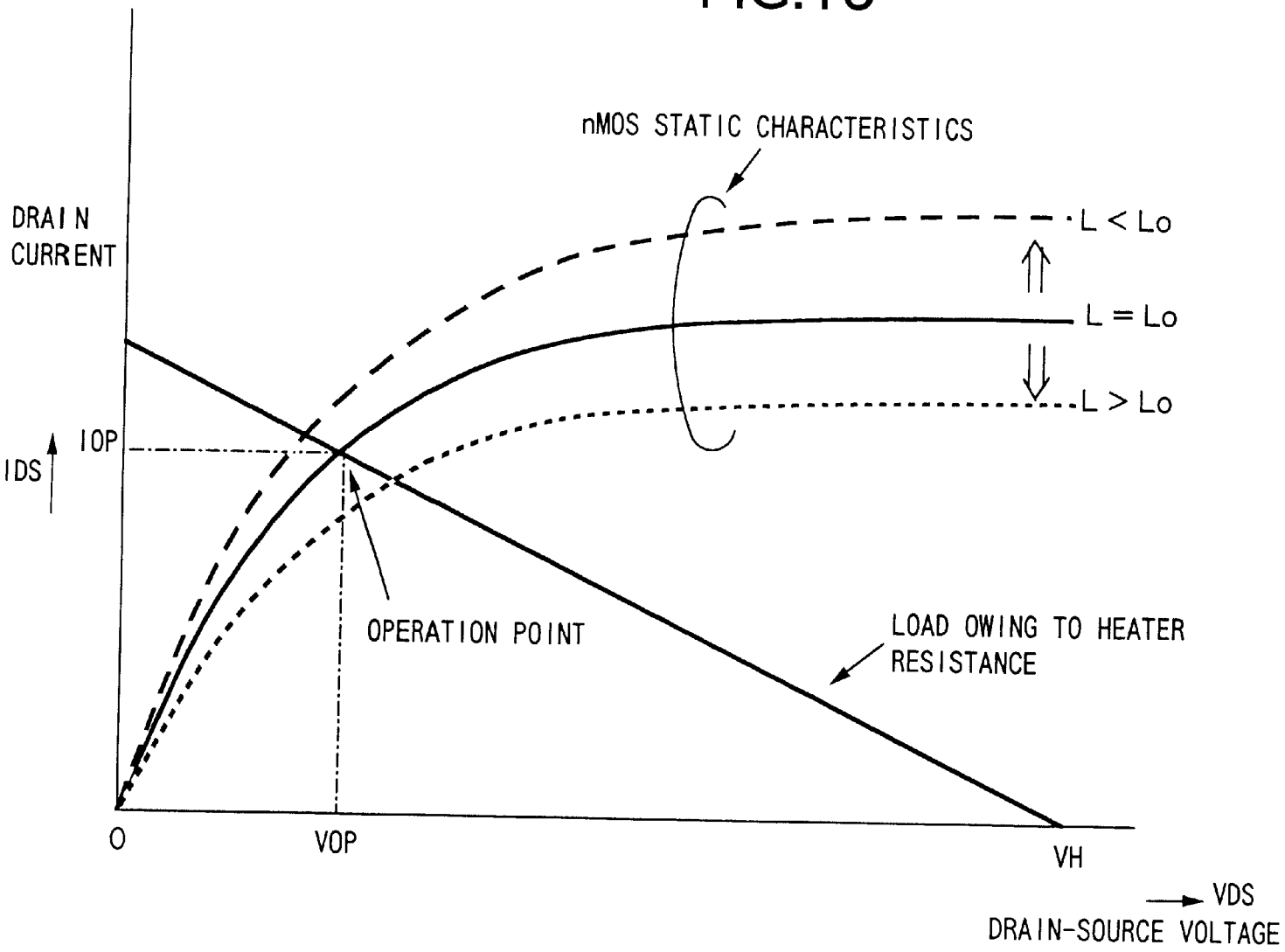
FIG. 15 is a graph showing the VD–ID characteristics of an nMOS transistor.

In this embodiment, when MOS transistors are used as power transistors, as shown in FIG. 12, gate voltage boosters 111 are inserted between switches 506 and power transistors 410, as shown in FIG. 14. Each gate voltage booster 111 converts the voltage amplitude of a digital signal output from a corresponding latch 501 into a higher voltage amplitude, and applies the signal with the converted amplitude to the gate of the power transistor 410, thereby increasing the driving force of the power transistor. By increasing the driving power of each power transistor, the area required for each power transistor in a driving circuit can be reduced, and hence, a size reduction of the entire circuit can be realized.

First Embodiment

Figure 5:
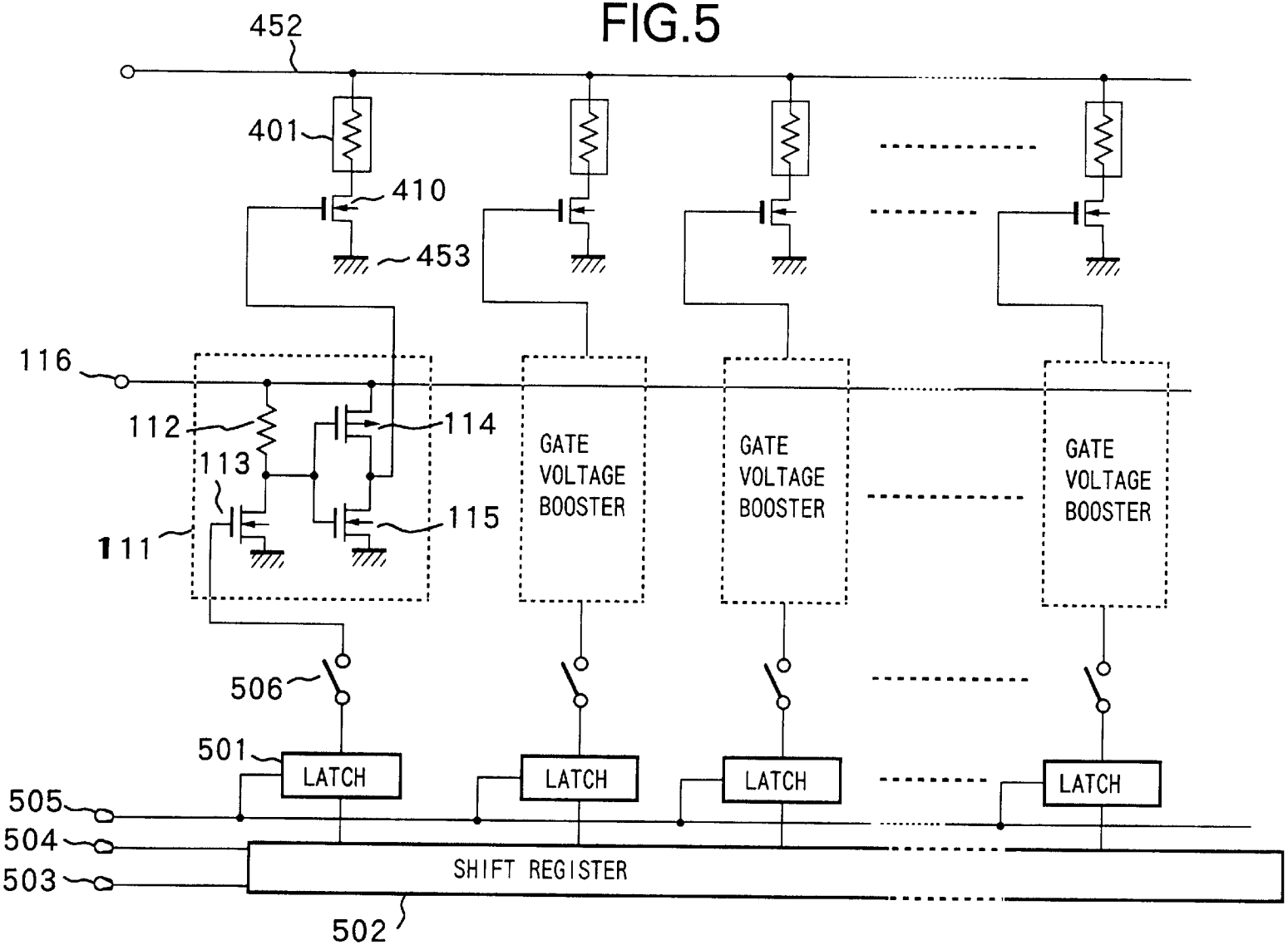
FIG. 5 is a circuit diagram showing the arrangement of a logic circuit of a recording head according to the first embodiment of the present invention.

FIG. 5 is a circuit diagram showing the logic circuit arrangement of the first embodiment of the recording head 810 shown in FIG. 1, and also showing the arrangement of the gate voltage booster shown in FIG. 14 in detail. Note that the same reference numerals in FIG. 5 denote the same parts as those in the conventional recording head shown in FIGS. 10 and 12, and a detailed description thereof will be omitted. The characteristic elements of this embodiment alone will be explained below.

Referring to FIG. 5, reference numeral 111 denotes gate voltage boosters each for converting the voltage amplitude of a digital signal output from a corresponding latch 501 into a higher voltage amplitude, and applying the signal with the converted amplitude to the gate of a corresponding power transistor 410; and 116, a power supply line for the gate voltage boosters 111. Each gate voltage booster 111 is built by a resistor 112, an nMOS transistor 113, the drain of which is connected to the resistor 112, and a CMOS inverter constituted by a pMOS transistor 114 and an nMOS transistor 115.

Note that the number of bits of image data stored in a shift register 502, the number of power transistors 410, and the number of heaters 401 are equal to each other.

Figure 10:
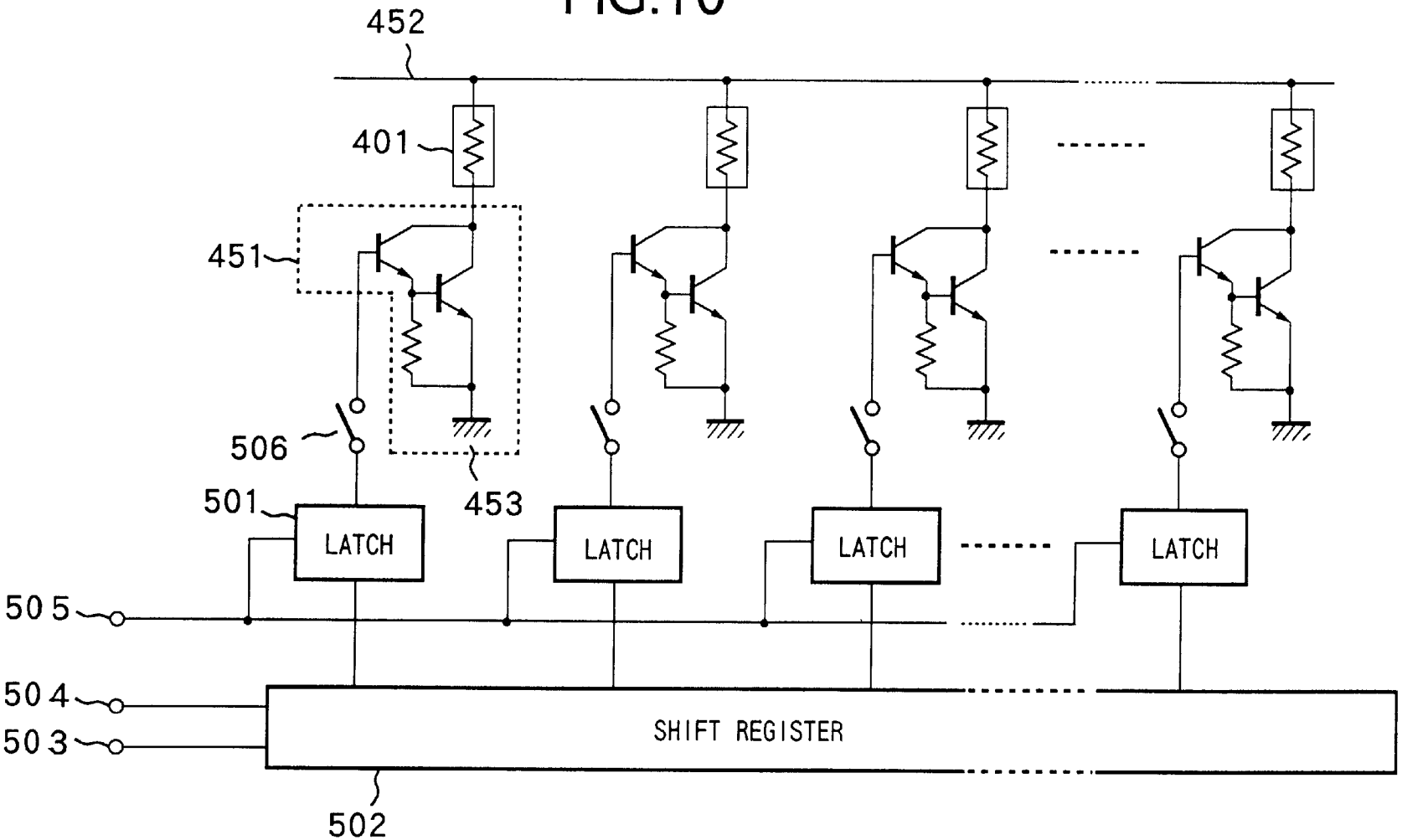
FIG. 10 is a circuit diagram showing the circuit arrangement of a conventional recording head according to the ink-jet method.
Figure 11:
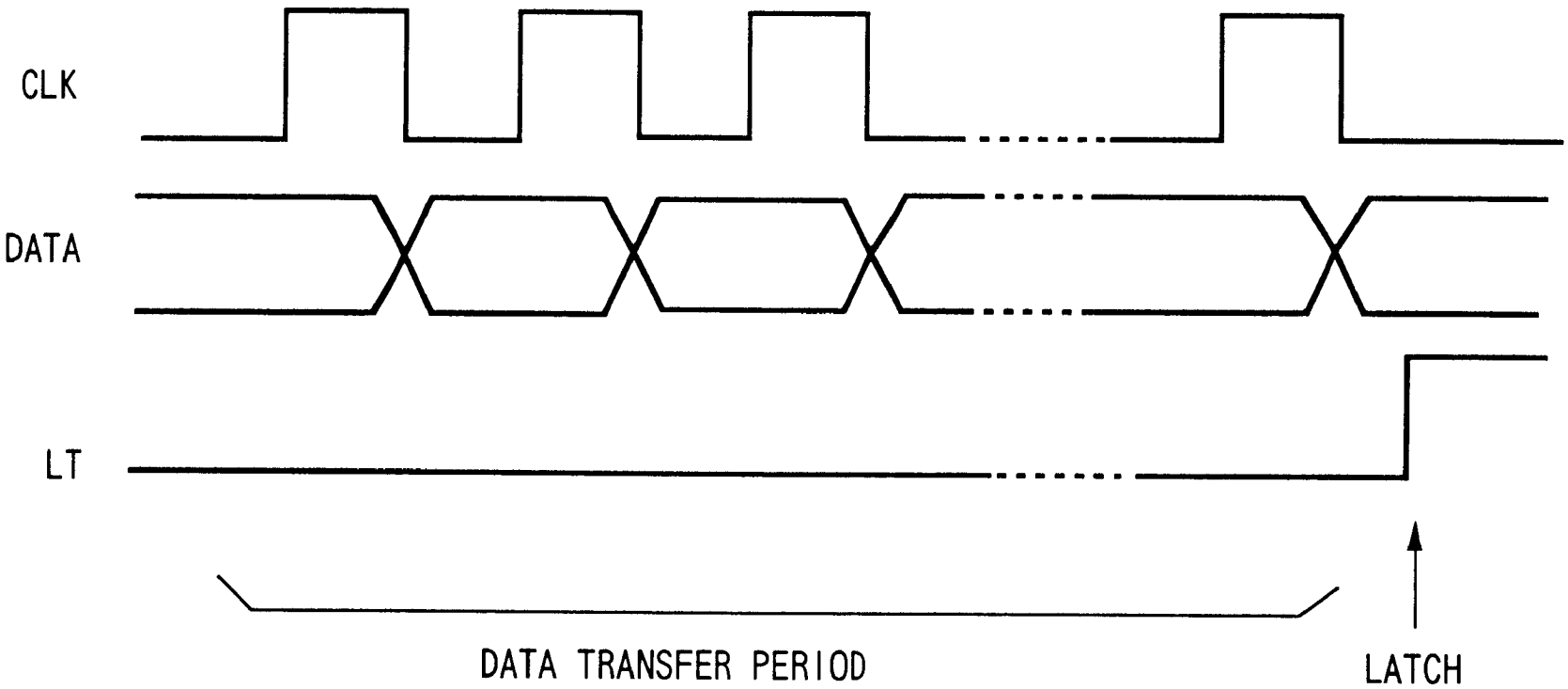
FIG. 11 is a timing chart showing various signals for driving the driving circuit of the recording head shown in FIG. 10.

The recording head 810 with the above-mentioned circuit arrangement performs the same operations as those of the conventional recording head shown in FIG. 10 in accordance with the timing chart shown in FIG. 11.

More specifically, image data (DATA) for turning on/off the heaters 401 is input from an image data input terminal 503 of the shift register 502 in synchronism with the leading edge timing of the transfer clock pulses. Since the number of bits of the image data stored in the shift register 502 is equal to the number of heaters 401 and the number of power transistors 410 for current driving, the transfer clock pulses (CLK) are input in correspondence with the number of heaters 401 to transfer the image data (DATA) to the shift register 502. Thereafter, a latch signal is supplied to a latch signal input terminal 505 to latch image data corresponding to the heaters in the latch circuits 501.

Thereafter, when switches 506 are turned on, Low/Hi signals corresponding to image data are output from the latch circuits 501, and the output voltages are applied to the gates of the nMOS transistors 113 in the gate voltage booster 111.

A case will be examined below wherein the output from a certain latch circuit 501 is "Low". At this time, since the nMOS transistor 113 is turned off, the voltage from the power supply line 116 is directly supplied to the gate of the CMOS inverter constituted by the pMOS transistor 114 and the nMOS transistor 115 via the resistor 112. Since the output from the CMOS inverter goes "Low", a voltage "0 V" is supplied to the gate of the corresponding power transistor 410. More specifically, when the output from the latch circuit 501 is "Low (no image data or the value of an image signal is "0")", the gate voltage of the power transistor 410 is set at "0 V", and no current is supplied to the heater 401. As a result, no printing is done.

Next, a case will be examined below wherein the output from a certain latch circuit 501 is "Hi". At this time, since the shift register 502 and latch circuits 501 are normally made up of CMOS gates, and all the external transfer clock pulses (CLK), image signal (DATA), latch timing signal (LT) have a signal amplitude of 0 V/5 V, the power supply voltage associated with each latch circuit 501 is often 5 V. Hence, when the output from the latch circuit 501 is "Hi", its signal voltage is 5 V. The voltage of 5 V is applied to the gate of the nMOS transistor 113 via the switch 506. In response to this voltage signal, since the nMOS transistor 113 is turned on, a current flows via the resistor 112.

When the resistance of the resistor 112 is set at a value sufficiently larger than that in the ON state of the nMOS transistor 113, a voltage close to 0 V is supplied to the gate of the CMOS inverter, and the input from the gate of the CMOS inverter can be set in the "Low" state. In this manner, the output from the CMOS inverter goes "Hi", and the voltage value of the power supply line 116 directly appears as the output voltage level at that time. This voltage is supplied to the gate of the power transistor 401. More specifically, when the output from the latch circuit 501 is "Hi (the value of an image signal being "1")", the voltage on the power supply line 116 is applied to the gate of the power transistor 410 to turn on the power transistor 410, and a current is supplied to the heater 401, thus performing printing by ejecting ink.

At this time, when the voltage on the power supply line 116 is set to be higher than 5 V as the power supply voltage of the shift register 502 and latch circuits 501, the voltage is applied to the gate of the power transistor 410, thus improving the drivability of the power transistor 410. The voltage on the power supply line 116 at this time can be arbitrarily set. For example, the highest possible voltage within the allowable range of the breakdown voltage of the CMOS inverter is preferably set. For example, the voltage of a power supply line 452 to the heaters 401 and the power supply line 116 of the gate voltage boosters 111 may be commonly used, and with this arrangement, desired characteristics can be obtained without using two power supplies, thus simplifying the recording head.

In this embodiment, current is supplied from the power supply line 116 for the gate voltage booster 111 when the nMOS transistor 113 is ON; no current is supplied when the transistor 113 is OFF. Normally, in an ink-jet recording apparatus, the number of heaters 401 which are to be simultaneously turned on is often limited to about 1/10 of the total number of heaters in association with the power supply performance of the recording apparatus, and in many cases, the number of OFF heaters is larger than that of ON heaters. Hence, when currents are supplied to the gate voltage boosters corresponding to the OFF heaters, if the number of OFF heaters is large, a large current is supplied to one gate voltage booster as a whole. In the state wherein all the heaters are OFF, i.e., in a so-called idling state, if currents are supplied to the gate voltage boosters corresponding to all the heaters, such currents raise the temperature of the chip, thus adversely influencing the operation and service life of the recording head.

For these reasons, it is preferable that no current be supplied to the gate voltage boosters corresponding to OFF heaters. In this embodiment, no current flows when the nMOS transistor 113 is OFF.

Therefore, according to the above-mentioned embodiment, the gate voltage boosters 111 are inserted between the power transistors 410 for driving the heaters of the recording head, and the latch circuits 501 for outputting image data, and when the heater is driven, the corresponding power transistor 410 can be driven by a voltage higher than the output voltage from the latch circuit 501. Especially, when an nMOS transistor is used as the power transistor, the drivability of the power transistor can be improved. Upon manufacturing the recording head with the above-mentioned circuit arrangement, no extra process is required.

Since no current flows when the nMOS transistor 113 that constitutes the gate voltage booster 111 is OFF, no unwanted consumption power is generated, and the operation and service life of the recording head do not have any adverse influence.

In the description of the above embodiment, the voltage on the power supply line 116 for the gate voltage boosters 111 is preferably set at the highest possible value without exceeding the breakdown voltage of the CMOS inverter, and can be commonly used as the heater voltage if possible. However, since the heater voltage is normally set at a high voltage of 20 V or higher, and the breakdown voltage of the CMOS inverter is about 15 V, it is difficult to share the power supply in practice. However, adding a power supply for the gate voltage boosters 111 leads to an increase in circuit scale in the recording apparatus as a whole, resulting in an increase in cost.

Accordingly, in order to satisfy such requirement, an arrangement for voltage-dividing the heater power supply voltage, and supplying the divided voltage to the gate voltage boosters 111 may be added to the circuit of the recording head shown in FIG. 5.

Second Embodiment

Figure 6:
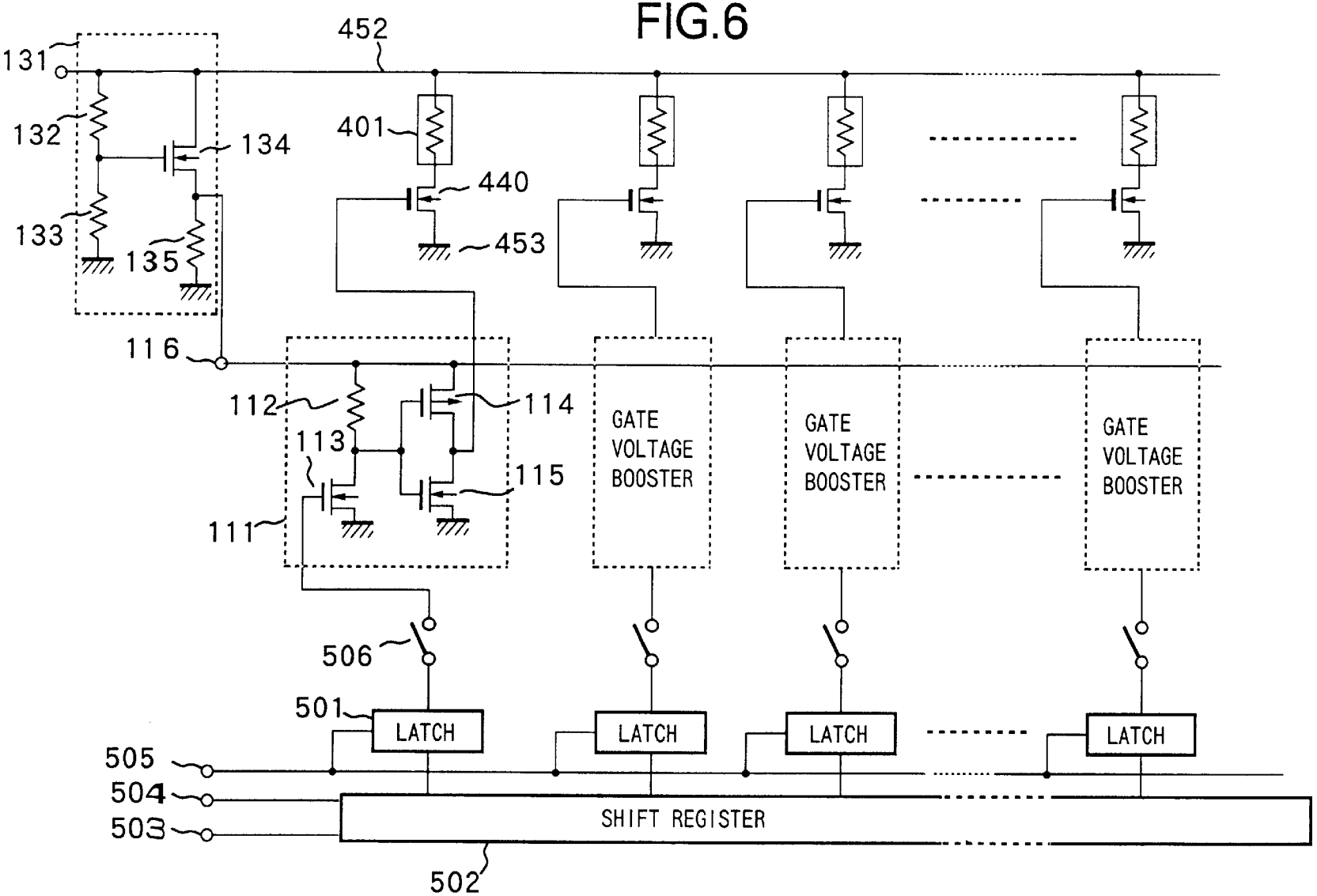
FIG. 6 is a circuit diagram showing the arrangement of a logic circuit of a recording head, in which a circuit for voltage-dividing a heater power supply voltage, and supplying it to a voltage converter is added to the logic circuit arrangement shown in FIG. 5, according to the second embodiment of the present invention.

FIG. 6 is a circuit diagram showing the arrangement of a recording head in which a circuit for voltage-dividing a heater power supply voltage and supplying the divided voltage to the gate voltage booster is added to the arrangement of the recording head shown in FIG. 5.

Referring to FIG. 6, reference numeral 131 denotes a voltage supply circuit for supplying a power supply voltage onto the power supply line 116 for the gate voltage boosters 111 using a voltage supplied from the power supply line 452 to the heaters 401; 132 and 133, resistors; 134, an nMOS transistor; and 135, a resistor connected to the source of the nMOS transistor 134. The nMOS transistor 134 and the resistor 135 form a source-follower type buffer.

With this arrangement, a voltage is generated based on the voltage from the heater power supply line 452 at the voltage dividing ratio of the resistors 132 and 133, and is supplied to the gate voltage booster 111 via the source-follower circuit built by the nMOS transistor 134 and the resistor 135. In this manner, an optimal voltage can be supplied to each gate voltage booster 111 without adding another power supply. Since such buffer is arranged, a voltage drop caused by a current that flows when the nMOS transistor 113 in each gate voltage booster 111 is turned on can be absorbed, and consequently, a voltage can be supplied to each gate voltage booster 111 without impairing the circuit characteristics.

Third Embodiment

Figure 7:
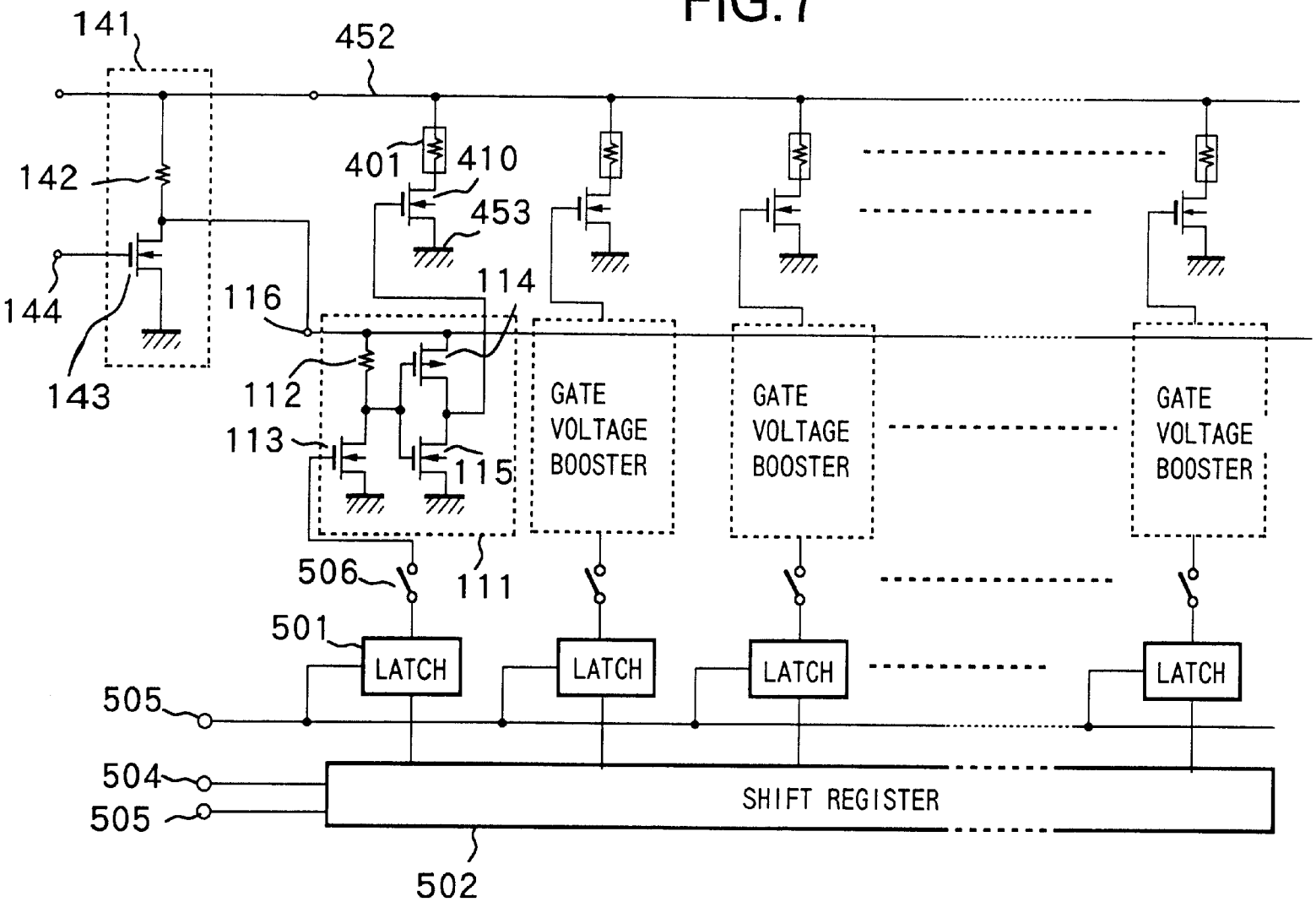
FIG. 7 is a circuit diagram showing the arrangement of a driving circuit of a recording head according to the third embodiment of the present invention.

FIG. 7 is a circuit diagram showing the arrangement of a driving circuit of a recording head. Note that the same reference numerals in FIG. 7 denote the same parts as those in the recording head shown in FIG. 5, and a detailed description thereof will be omitted. The characteristic elements of this embodiment alone will be explained below.

Referring to FIG. 7, reference numeral 141 denotes a correction circuit for applying a desired voltage to the gate voltage boosters 111. The correction circuit 141 is built by a polysilicon resistor 142, an nMOS transistor 143, and an input terminal 144 for determining the ON resistance when the nMOS transistor 143 is ON. Note that the polysilicon electrodes of the circuit formed by the polysilicon resistor 142, the nMOS transistor 143, and the power transistors 410 are formed in a single manufacturing process.

The recording head with the above-mentioned arrangement performs the same operations as those of the conventional recording head shown in FIG. 10 in accordance with the timing chart shown in FIG. 11.

A case will be examined below wherein the output from a certain latch circuit 501 is "Low". At this time, since the nMOS transistor 113 is turned off, the voltage on the power supply line 116 is directly applied to the gate of the CMOS inverter constituted by the pMOS transistor 114 and the nMOS transistor 115 via the resistor 112. In response to this voltage, since the output from the CMOS inverter goes "Low", a voltage "0 V" is supplied to the gate of the corresponding power transistor 410. More specifically, when the output from the latch circuit 501 is "Low (no image data or the value of an image signal is "0")", the gate voltage of the power transistor 410 is set at "0 V", and no current is supplied to the heater 401. As a result, no printing is done.

Next, a case will be examined below wherein the output from a certain latch circuit 501 is "Hi". Since the shift register 502 and latch circuits 501 are normally made up of CMOS gates, and all the external transfer clock pulses (CLK), image signal (DATA), latch timing signal (LT) have a signal amplitude of 0 V/5 V, a power supply voltage associated with each latch circuit 501 is often 5 V. Hence, when the output from the latch circuit 501 is "Hi", its signal voltage is 5 V. The voltage of 5 V is applied to the gate of the nMOS transistor 113 via the switch 506. In response to this voltage signal, since the nMOS transistor 113 is turned on, a current flows via the resistor 112.

At this time, when the resistance of the resistor 112 is set at a value sufficiently larger than the ON resistance of the nMOS transistor 113, a voltage very close to 0 V is supplied to the gate of the CMOS inverter, and the output from the CMOS inverter goes "Hi". Hence, the voltage value on the power supply line 116 directly appears as the output voltage level of the CMOS inverter, and is supplied to the gate of the power transistor 410.

More specifically, when the output from the latch circuit 501 is "Hi", the voltage on the power supply line 116 is applied to the gate of the power transistor 410 to turn it on. As a result, a current is supplied to the heater 401 to heat ink, and ink is ejected to attain printing. In this manner, the voltage applied to the gate electrode of the power transistor 410 is that of the power supply line 116. This voltage is generated by the correction circuit 141.

In the manufacturing process of the recording head, the polysilicon electrodes of the polysilicon resistor 142 and the nMOS transistor 143 are formed simultaneously with the polysilicon gate electrodes of the nMOS transistors 410 as the power transistors for supplying currents to the heaters 401, and these electrode sizes are designed, as will be described below. Hence, the correction circuit 141 operates as a circuit for suppressing changes in ink ejection state with changes in driving force of each power transistor 410.

More specifically, when an MPA is used as an aligner, as described in the prior art, the gate length (L) of an nMOS transistor suffers process variations of a maximum of ±0.5 to ±1.0 μm with respect to its design value. Such process variations depend on the exposure condition and etching condition, and drift considerably among manufacturing lots and among wafers. On the other hand, as for variations in a single wafer, the above-mentioned variations have occurred with respect to the design value, but relative variations in the wafer are relatively small. That is, if the polysilicon width of a certain portion of a wafer is 1 μm smaller than the design value, the polysilicon widths of other portions are similarly expected to be 1 μm smaller than the design value.

A case will be examined below wherein the design value of the polysilicon gate length (L) of the power transistor 410 is 4 μm, and this value has changed to 3 μm due to process variations.

In this case, as can be understood from equation (1), since the driving force of the MOS transistor increases by 4/3, the energy generated by the heater 401 becomes larger than the design value. As a result, ink scorches, or the heater service life is shortened.

At this time, if the width of the polysilicon resistor 142 in the correction circuit 141 and the gate length (L) of the nMOS transistor 143 are designed at 4 μm, and the directions of the polysilicon gates of the power transistors 410 and the nMOS transistors 143 agree with the direction of the polysilicon resistor 142, these values are similarly expected to change to 3 μm in a single wafer.

A case will be explained below wherein the circuit is designed so that the voltage on the power supply line 452 becomes 24 V and the voltage on the power supply line 116 becomes 16 V, i.e., the ratio of the polysilicon resistor 142 to the ON resistance of the nMOS transistor 143 is 1:2.

Since the width of the polysilicon resistor 142 changes from 4 μm to 3 μm like in the gate length (L) of each power transistor 410, the resistance of the polysilicon resistor 142 increases to 1.33 times. On the other hand, since the gate length (L) of the nMOS transistor 143 in the correction circuit 141 changes from 4 μm to 3 μm, the ON resistance of the nMOS transistor decreases to 0.75 times. As a result, the voltage generated by the correction circuit 141 and supplied to the power supply line 116 changes from 16 V as the design value to about 12.5 V.

As has already described above, this voltage is applied to the gate electrode of each power transistor 410. Since the gate voltage (VG) and the drain current (IDS) have the relationship given by equation (1), when the gate voltage (VG) changes from 16 V to 12.5 V, the drain current (IDS) changes to about 0.75 times. Therefore, when the gate length of each power transistor 410 changes, the driving force of the MOS transistor increases to about 1.33 times, but changes in driving force by the MOS transistor with changes in gate voltage (VG) are about 0.75 times. Hence, changes in driving force of the MOS transistor are about 0.998 times as a whole, i.e., the driving force changes little.

As described above, when the gate length of each power transistor 410 becomes smaller than the design value, it acts to improve the driving force of the MOS transistor. However, since the voltage applied to the gate electrode of the transistor lowers by the operation of the correction circuit 141, the driving force of the MOS transistor is suppressed. Conversely, when the gate length of each power transistor 410 becomes larger than the design value, it acts to decrease the driving force of the MOS transistor. However, since the voltage applied to the gate electrode of the transistor increases, decrease in driving force of the MOS transistor is suppressed.

As described above, according to this embodiment, even when the driving force of the MOS transistor drifts due to variations in the manufacturing process, the correction circuit 141 operates to compensate for such drifts, and controls the driving force of each MOS transistor, thus minimizing the influence of drifts on ink ejection. Hence, variations in ink ejection ascribed to variations of the characteristics of the power transistors that build the circuit of the recording head can be suppressed, and more stable ink ejection can be realized, thus printing an image with higher quality.

Since no heavy load acts on the heaters, this embodiment can contribute to prolong the service life of the recording head.

In the description of the above embodiment, the gate lengths of the power transistors 410, the width of the polysilicon resistor 142, and the gate length of the nMOS transistor 143 have equal design values. In an actual manufacturing process of a recording head, when the circuit is designed in this manner, the driving forces of the MOS transistors can be corrected best. However, the present invention is not limited to such specific arrangement, and these values need not always assume identical design values.

In the above embodiment, the correction circuit 141 is constituted by the polysilicon resistor and the MOS transistor. However, the present invention is not limited to such specific circuit arrangement. Either one of these elements may be used, and for example, a correction circuit may be made up by a combination of a polysilicon resistor having substantially the same width as the gate length of the power transistor, and a polysilicon resistor which is thick enough not to be influenced by process variations.

In the above embodiment, the gate voltage boosters 111 correspond to a circuit arrangement formed by the CMOS process. However, the present invention is not limited to such specific arrangement.

Fourth Embodiment

Figure 8:
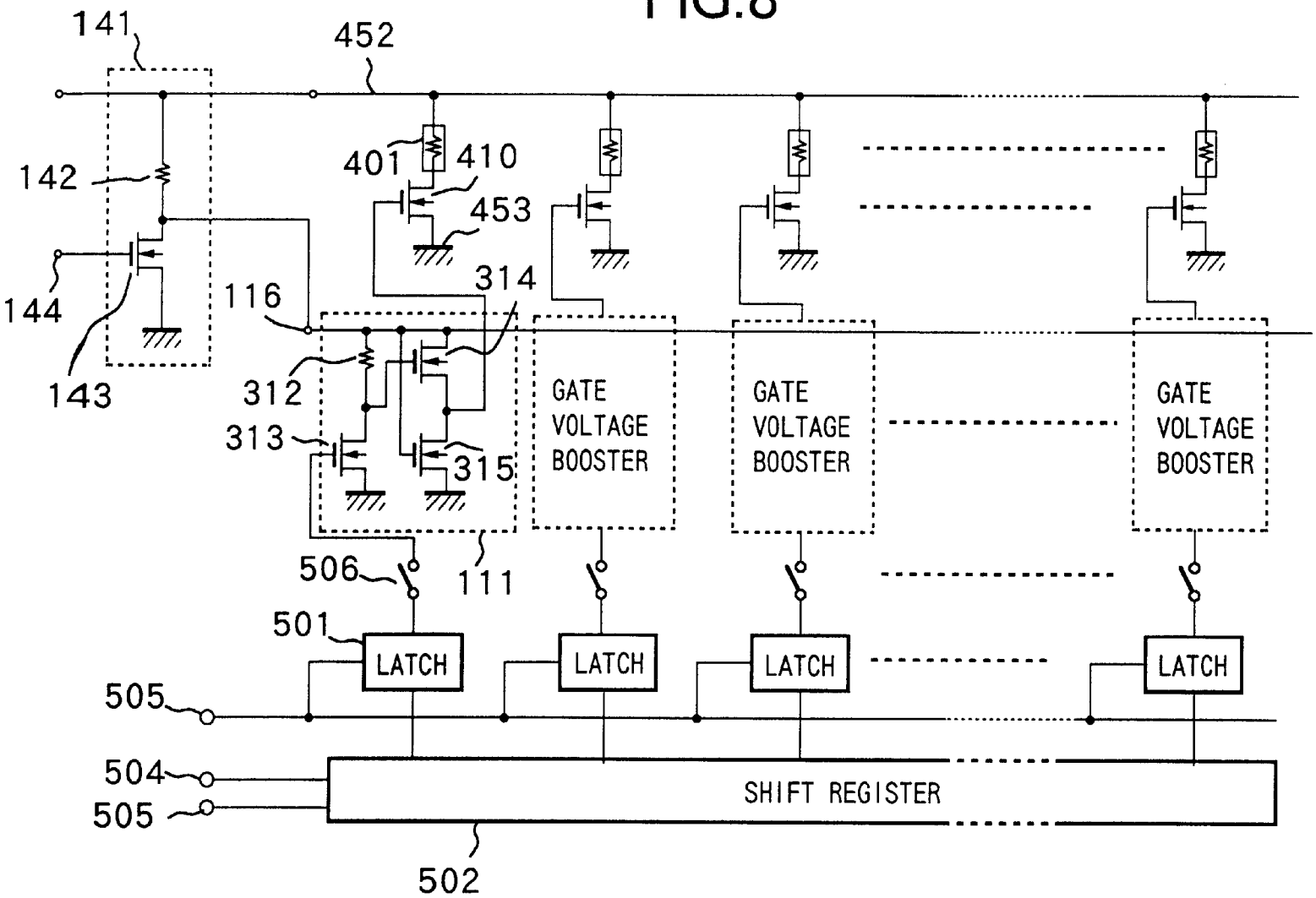
FIG. 8 is a circuit diagram when the circuit shown in FIG. 7 is fabricated by an nMOS process according to the fourth embodiment of the present invention.

For example, as shown in FIG. 8, each gate voltage booster 111 may be built by nMOS transistors alone. In FIG. 8, reference numeral 312 denotes a resistor; and 313 to 315, nMOS transistors.

In this manner, when each gate voltage booster 111 is built by nMOS transistors alone, and the logic circuits such as the shift register, latch circuits, and the like are also built by nMOS transistors alone, the circuit of the recording head can be manufactured by an nMOS process, and the manufacturing cost can be reduced although consumption power becomes larger than that in a CMOS circuit.

Fifth Embodiment

In the above embodiment, upon ejecting ink, the nMOS transistor 113 is turned on, and currents flow from the power supply line 116 to GND. At this time, in order to suppress changes in voltage of the power supply line 116, the resistance of the resistor 142 and the ON resistance of the nMOS transistor 143 must be set to be sufficiently smaller than the resistance of the resistor 112. With this arrangement, however, a large punch-through current is generated from the power supply line 452 to GND via the resistor 142 and the MOS transistor 143, and electric power is consumed.

Figure 9:
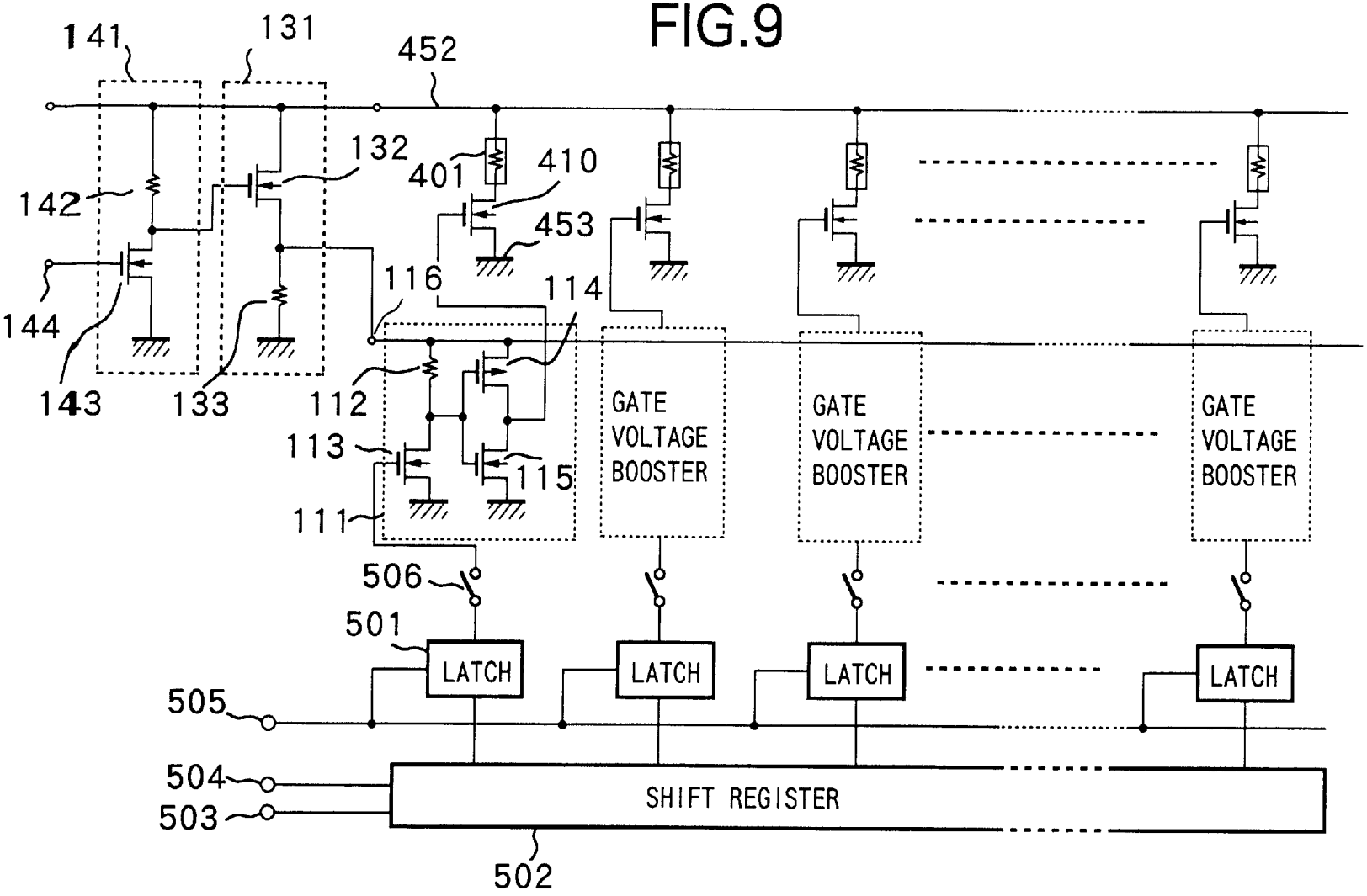
FIG. 9 is a circuit diagram showing the arrangement of a driving circuit of a recording head according to the fifth embodiment of the present invention.

In this embodiment, in order to reduce such consumption power, a buffer 131 is inserted between the correction circuit 141 and the power supply line, and the circuit of the recording head is arranged, as shown in FIG. 9. In FIG. 9, reference numeral 131 denotes a source-follower buffer that converts an input/output impedance; 132, an nMOS transistor; and 133, a resistor. As can be seen from the circuit arrangement shown in FIG. 9, the basic operation of the circuits other than the source-follower buffer 131 is the same as that in the circuit shown in FIG. 7.

In order to drive each heater 401 by such circuit arrangement, the drain current of the nMOS transistor 132 need only be supplied onto the power supply line 116. On the other hand, this current is controlled by the gate voltage of the nMOS transistor 132. Accordingly, only the voltage output from the correction circuit 141 and applied to the gate of the nMOS transistor 132 is important, and the correction circuit 141 may have low current supply performance. Hence, the resistance of the resistor 142 and the ON resistance of the MOS transistor 143 can be increased. As a result, currents that flow from the power supply line 452 to GND via the resistor 142 and the MOS transistor 143 become small, and the consumption power can be suppressed.

In this embodiment, when the output from the correction circuit 141 is input to the buffer 131, and the corresponding buffer output is generated as the source-drain current of the nMOS transistor 132, a voltage drop corresponding to the threshold voltage (VTH) of the nMOS transistor 132 is generated. However, the basic operation is the same as that in the above embodiment.

Therefore, according to this embodiment, extra power consumption can be minimized, and the consumption power can be further reduced.

An improved arrangement of each gate voltage booster required for driving the power transistor will be explained below.

Figure 21A:
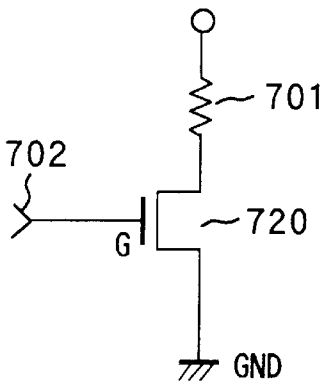
FIG. 21A is a circuit diagram of a conventional driving circuit for a heating element using a MOS power transistor.

Even if a logic output 721 as a voltage of about 3 to 8 V (normally, 5 V) is applied to the gate (G) of a power transistor, as shown in FIG. 21A, it is hard to supply currents of at least 100 to 200 mA required for foaming ink to a heating element. Even if it is possible, the ON voltage in the drain (D)-source (S) path becomes large, and energy is wastefully consumed. Accordingly, in order to improve the driving performance of the power transistor, a gate voltage booster 740 for boosting the voltage applied to the gate (G) of the power transistor is arranged at the input side of the an nMOS power transistor 720.

Figure 23:
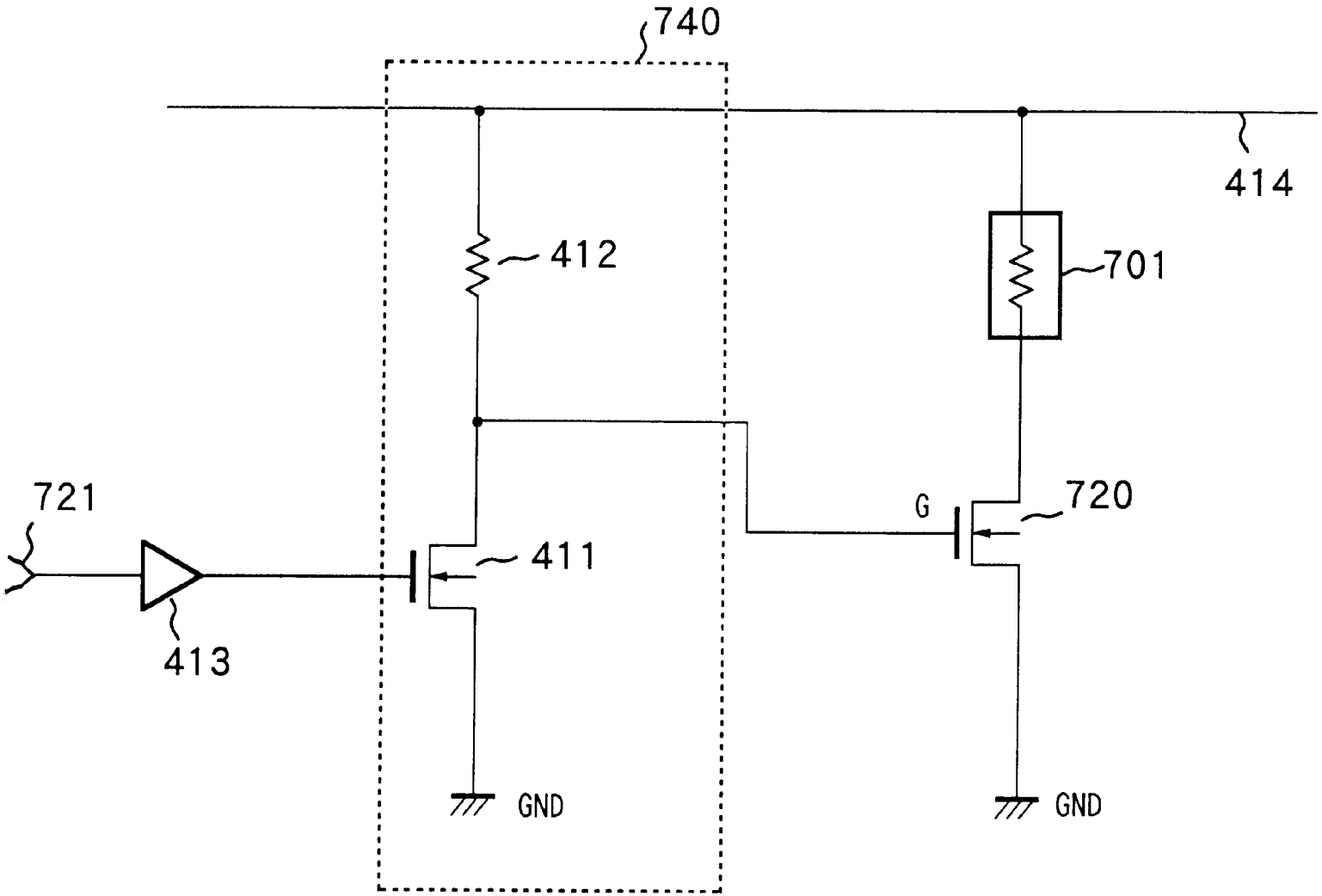
FIG. 23 is a circuit diagram of a circuit for boosting the gate voltage of a power transistor.

FIG. 23 shows an example of the arrangement of the gate voltage booster 740. Referring to FIG. 23, reference numeral 411 denotes an offset nMOS transistor; 412, a booster resistor; and 413, an operational amplifier. Also, reference numeral 414 denotes a power supply line input from a heating element power supply input pad 711. This circuit makes up an nMOS inverter using the offset nMOS transistor 411.

However, with this circuit arrangement, while the heating element is not driven, i.e., while the power transistor 720 is OFF, the nMOS transistor 411 is turned on, and a current flows based on a power supply voltage (VTH) 414 applied from a power supply via the booster resistor 412. Since this current is kept supplied during the non-driving period of the heating element, energy loss occurs. Also, when the number of heating elements increases, such current alone may raise the internal temperature of the recording head.

As shown in FIG. 5, when the gate voltage booster is arranged at the input side of the nMOS power transistor 410, a punch-through current can be prevented due to the CMOS circuit when the power transistor 410 is OFF. However, in the pMOS transistor 114 in the CMOS inverter circuit, it is hard to obtain a breakdown voltage nearly equal to the power supply voltage of about 20 V on the power supply line 452 for driving each heating element 401 in terms of the circuit arrangement. Hence, the breakdown voltage of the pMOS transistor 114 must be set at 10 to 14 V, and another power supply line 116 of 14 V or less must be additionally supplied from an external circuit. On the other hand, the power supply voltage of the power supply line 452 may be stepped down by an internal circuit and may be used as an inverter circuit power supply (not shown). In this case, however, basis for reduction of power loss caused by voltage step-down, and voltage drifts depending on the number of heating elements to be simultaneously driven by the power supply voltage of the inverter circuit, and the like are posed (not shown).

Sixth Embodiment

Figure 16A:
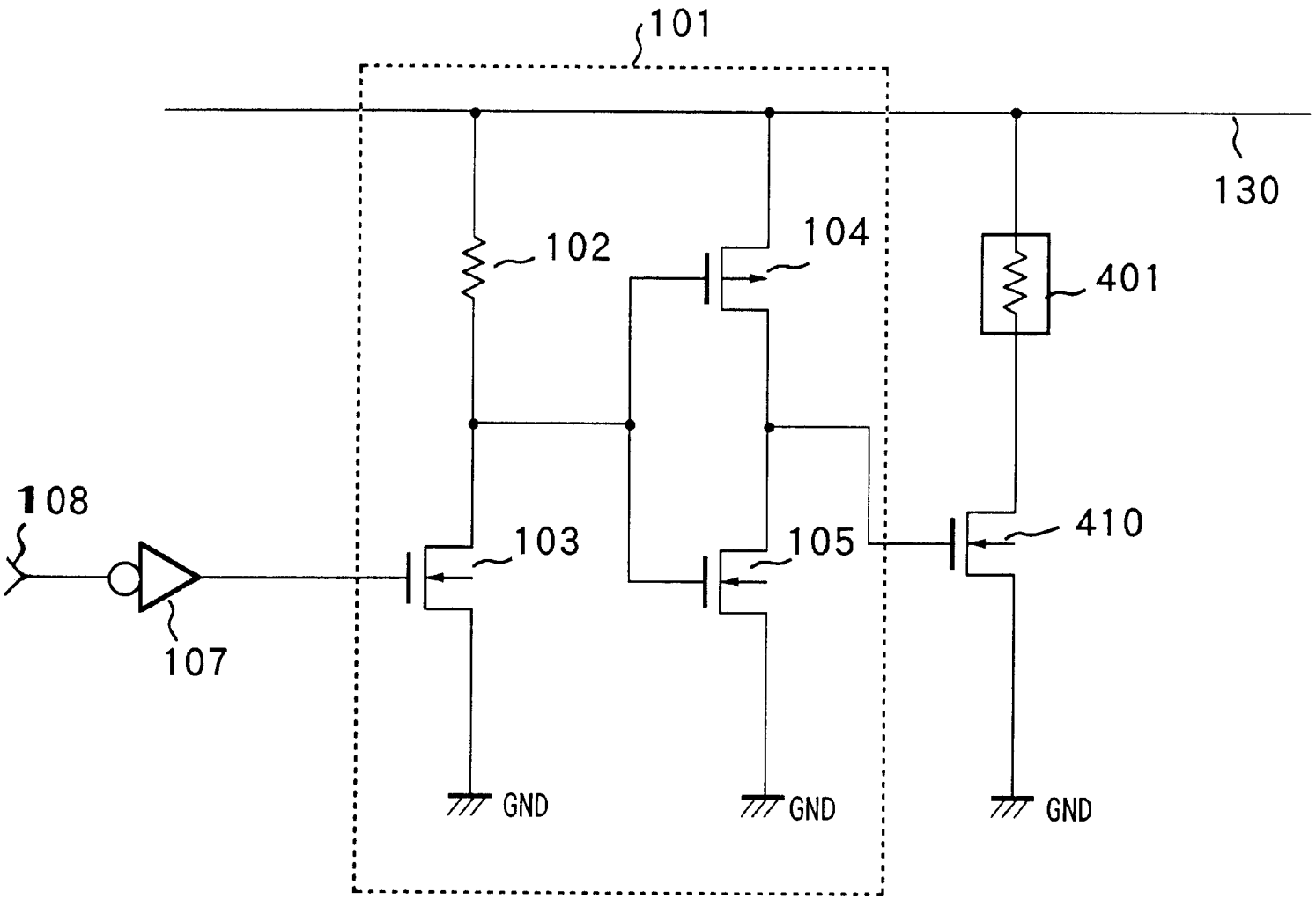
FIG. 16A is a circuit diagram of a heating element driving circuit mounted on an ink-jet recording head substrate according to the sixth embodiment of the present invention.

In order to solve such basis, in the sixth embodiment to be described below, a gate voltage booster is arranged, as shown in FIG. 16A.

FIG. 16A is a circuit diagram showing a heating element driving circuit mounted on an ink-jet recording head according to the sixth embodiment of the present invention, and showing a circuit from a logic circuit output 108 to a gate voltage booster 101 and an nMOS power transistor 410 via an inverter element 107.

Figure 17A:
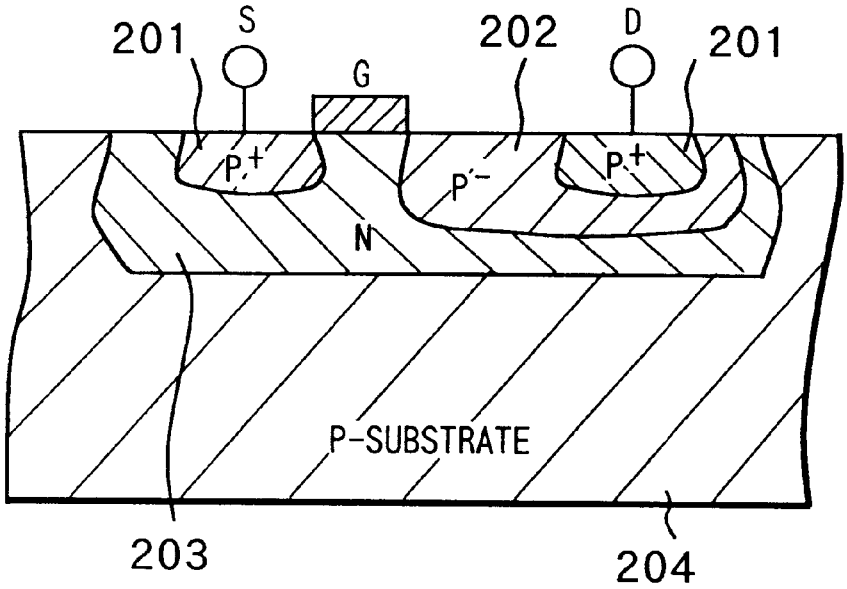
FIG. 17A is a sectional view showing the structure of an offset pMOS transistor shown in FIG. 16A.

Referring to FIG. 16A, reference numeral 104 denotes the characteristic feature portion of this embodiment, i.e., a high-breakdown voltage offset pMOS transistor which is formed by forming a $p^-$-type impurity region 202 shown in FIG. 17A between a $p^+$-type impurity layer 201 and the gate G of a pMOS transistor to raise its breakdown voltage from about 10 to 14 V of the conventional circuit to 250 V or higher, and builds an inverter circuit. Reference numeral 401 denotes a heating element; 410, an offset nMOS power transistor with a structure shown in FIG. 17B for driving the heating element 401; 103 and 105, high-breakdown voltage (25 V or higher) offset nMOS transistors which have the same structure as that of the offset nMOS power transistor 410, and constitute the gate voltage booster 101 for boosting the voltage to be applied to the gate of the offset nMOS power transistor 410 from the logic circuit output 108 and the inverter element 107 (0 V to 5 V) to a power supply line 130 (15 to 25 V); and 102, a booster resistor.

The operation of the heating element driving circuit mounted on the ink-jet recording head of this embodiment will be explained below.

Referring to FIG. 16A, when the nMOS power transistor 410 is OFF, i.e., when the heating element 401 is not driven (in the power-ON state of a recording apparatus, since the voltage application time to each heating element 401 upon ink-jet printing is about 3 to 7 $\mu$s with respect to a period of 100 to 200 $\mu$s, most power transistors are OFF, and it is important especially for battery-driven devices to reduce consumption power in the OFF state), the nMOS transistor 105 in the inverter circuit (104, 105) is turned on. However, since the pMOS transistor 104 is OFF, no punch-through current flows. Furthermore, since the nMOS transistor 103 at the input side of these transistors is OFF in this state, no punch-through current flows on this side, and the consumption power in the non-driving state approaches "0". Hence, by using the circuit structure shown in FIG. 5, a punch-through current, that flows in the non-driving state along the power supply line 414→the booster resistor 412→the nMOS transistor 411→GND, as described in FIG. 23, can be prevented. Furthermore, since the breakdown voltage of the pMOS transistor 104 can be set at 25 V or higher, no extra power supply line is required in addition to the power supply line 452, and the power supply line 452 can be shared with the power supply line 130, thus simultaneously realizing a reduction of power supply cost and a size reduction of the recording apparatus.

Figure 17B:
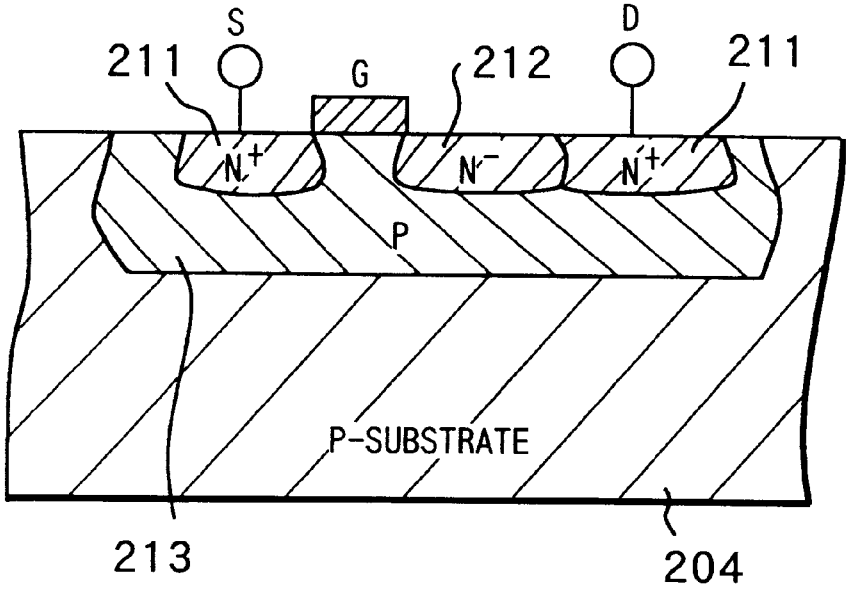
FIG. 17B is a sectional view showing the structure of an offset nMOS transistor shown in FIG. 16A.
Figure 18A:
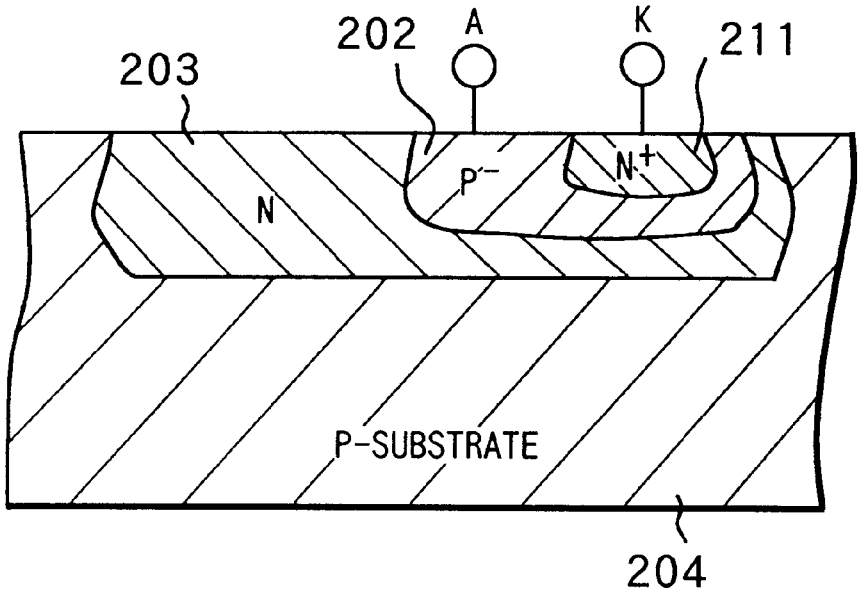
FIG. 18A is a sectional view showing the structure of a diode sensor according to an embodiment of the present invention.

Furthermore, in the above embodiment, as shown in FIGS. 17A and 17B, the $p^-$-type impurity layer 202 as the feature of this embodiment is doped deeper than the $n^-$-type impurity layer 212 and shallower than an n-type substrate region 203 that makes up the offset pMOS transistor 104, thus forming a diode sensor shown in FIG. 18A at the same time. In FIG. 18A, reference numeral 211 denotes an $n^+$-type impurity layer that makes up the source/drain of the offset nMOS transistor, and serves as the cathode (K) of the diode sensor; and 202, a $p^-$-type impurity layer which is the same as the $p^-$-type impurity layer of the offset pMOS transistor 104 (FIG. 17A) and serves as the anode (A) of the diode sensor.

Figure 21B:
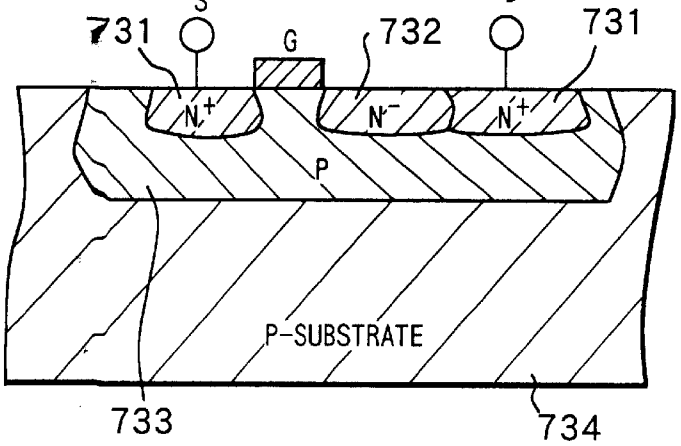
FIG. 21B is a sectional view showing the structure of a conventional offset nMOS power transistor.
Figure 21C:
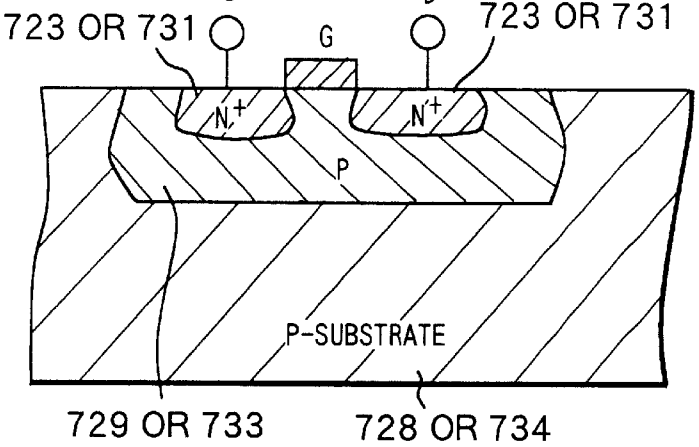
FIG. 21C is a sectional view of a substrate that forms an nMOS transistor used in a logic circuit when the entire logic circuit is formed by a CMOS process using a MOSFET as a power transistor.
Figure 21D:
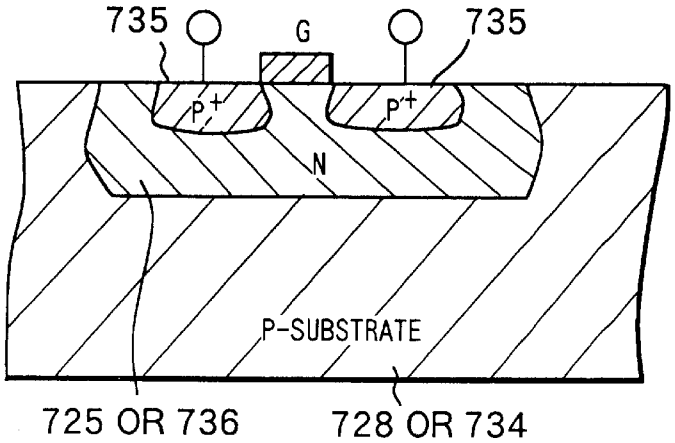
FIG. 21D is a sectional view of a substrate that constructs a pMOS transistor used in a logic circuit when the entire logic circuit is formed by a CMOS process using a MOSFET as a power transistor.
Figure 22:
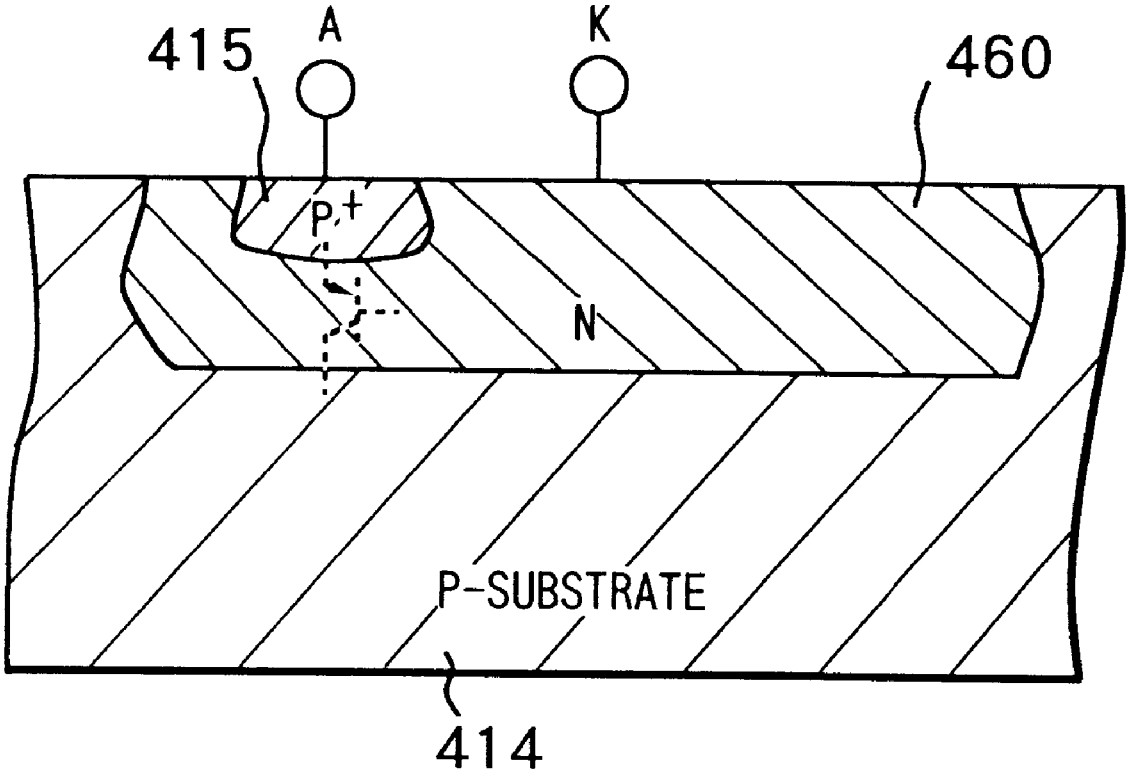
FIG. 22 is a sectional view showing the structure of a conventional diode sensor.

With the above-mentioned structure, in the conventional transistor structure shown in FIG. 21D, currents that flow to the regions other than the anode (A) and cathode (K) such as leakage current to the substrate produced by a parasitic pnp transistor formed by the $p^+$-type region (735), n-type region (725 or 736), and p-type substrate (728 or 734), and the like can be completely eliminated, and the problem of, e.g., latch-up due to the leakage current can be solved. In addition, the problem that diode sensors cannot be connected in series in the prior art can be solved at the same time, and diode sensors can be connected in series.

Furthermore, the merit of this embodiment lies in that the temperature characteristics of the diode sensor can be set within a broader range than the transistor structure of the third embodiment, since the temperature characteristics of the diode sensor depend mainly on the low-concentration impurity layer of a p-n junction, and the $p^-$-type impurity layer 202 (FIG. 18A) that makes up the anode A of this diode need only have a concentration high enough to obtain the breakdown voltage of the pMOS transistor.

Also, when the $p^-$-type impurity layer is added to the conventional MOS process structure to be shallower than the n-type layer that makes up the substrate of the pMOS transistor and to be deeper than the $n^+$-type layer that makes up the drain/source of the nMOS transistor, a CMOS inverter circuit which comprises a pMOS transistor that can withstand the heating element driving voltage can be constituted at the input side of the power transistor.

In addition, since the $p^-$-type layer is added, the diode sensor can have an npnp structure, and can be completely isolated from the p-type substrate, thereby eliminating the influence of a parasitic transistor and realizing a series connection of diode sensors.

Note that $p^+$-type layer/region denotes high impurity density of p MOS layer/region which shows low resistivity; $n^+$-type layer/region denotes high impurity density of n MOS layer/region which shows low resistivity; $p^-$-type layer/region denotes low impurity density of p MOS layer/region which shows high resistivity; and $n^-$-type layer/region denotes high impurity density of n MOS layer/region which shows high resistivity.

Another Embodiment

In the above embodiments, the cases using the nMOS power transistors have been exemplified. The present invention can be easily applied to a transistor structure using pMOS power transistors by reversing the conductivity types of all the impurity layers, and such structure is also included in the technical scope of the present invention.

Figure 16B:
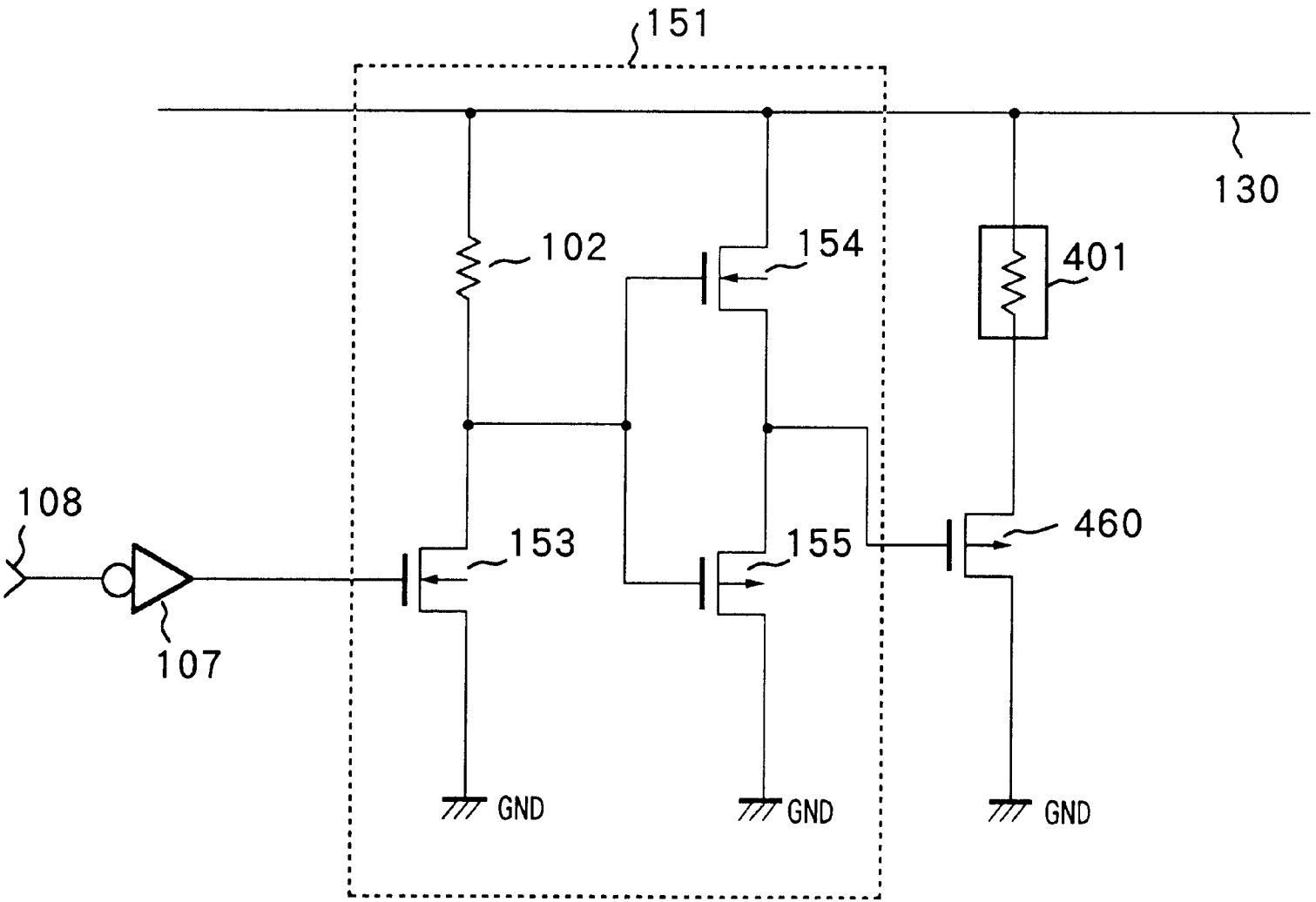
FIG. 16B is a circuit diagram of a heating element driving circuit mounted on an ink-jet recording head substrate according to another mode of the sixth embodiment of the present invention.
Figure 17C:
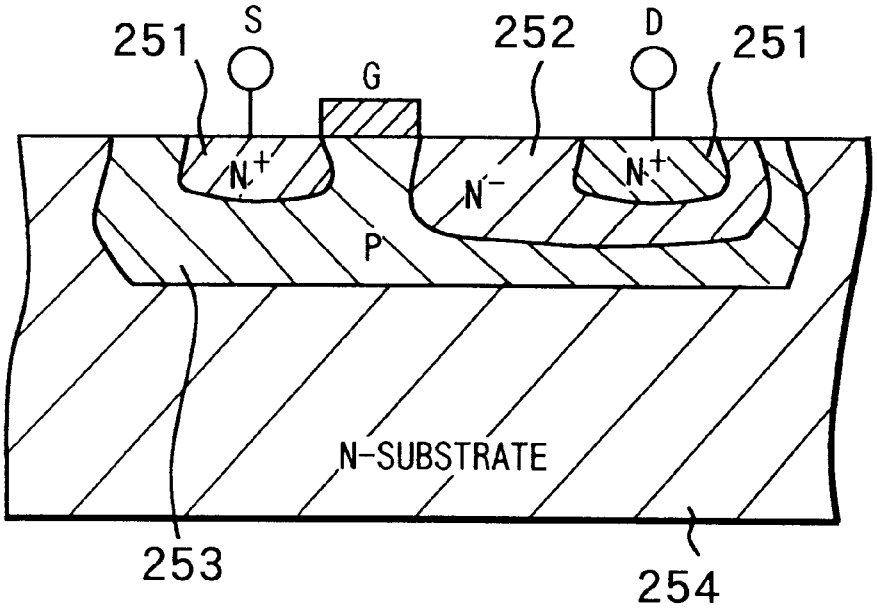
FIG. 17C is a sectional view showing the structure of an offset nMOS transistor shown in FIG. 16B.

More specifically, in FIG. 16B, reference numeral 154 denotes an nMOS transistor in which an $n^-$-type impurity layer 252 shown in FIG. 17C is formed between a drain $p^+$-type impurity layer 251 and the gate G of a pMOS transistor. Also, reference numeral 460 denotes an offset pMOS power transistor with a structure shown in FIG. 17B for driving the heating element 401. Reference numeral 155 denotes an offset pMOS power transistor having the same structure as that of the offset pMOS power transistor 460. Reference numeral 102 denotes a booster resistor.

Figure 17D:
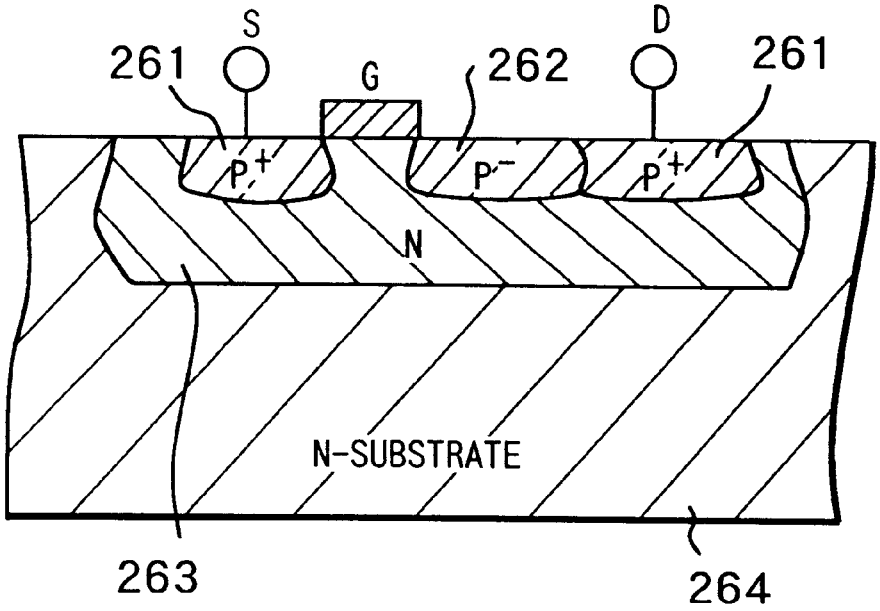
FIG. 17D is a sectional view showing the structure of an offset pMOS transistor shown in FIG. 16B.
Figure 18B:
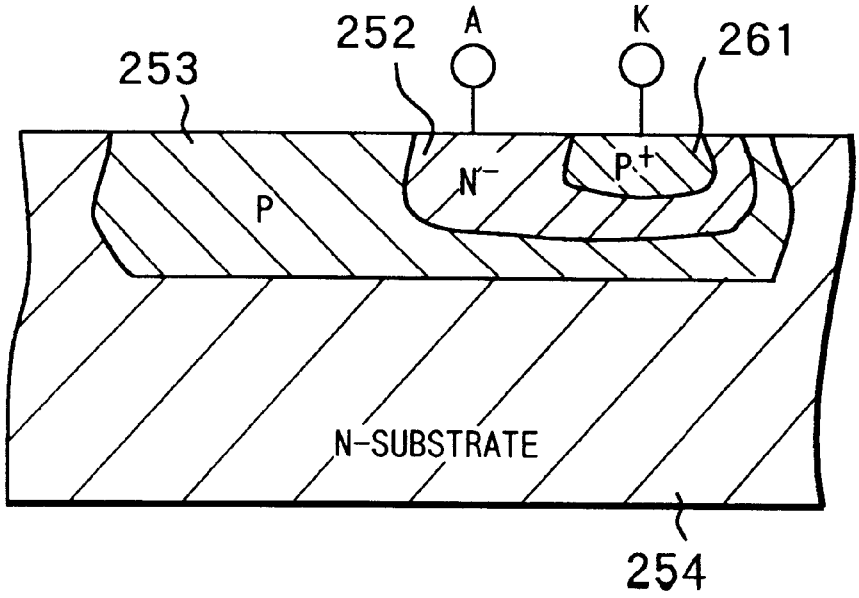
FIG. 18B is a sectional view showing the structure of a diode sensor according to another mode of the embodiment.

As shown in FIGS. 17C and 17D, when the $n^-$-type impurity layer 252 is doped deeper than a $p^-$-type impurity layer 262 that makes up the offset pMOS transistor 155 and shallower than a p-type substrate region 253 that makes up the offset nMOS transistor 154, a diode sensor shown in FIG. 18B can be simultaneously formed. In FIG. 18B, reference numeral 261 denotes a $p^+$-type impurity layer that makes up the drain/source of the offset pMOS transistor, and serves as the cathode (K) of the diode sensor; and 252, an $n^-$-type impurity layer which is the same as that of the offset nMOS transistor 252 (FIG. 17C) and serves as the anode (A) of the diode sensor.

Note that the gate voltage booster 111 shown in FIG. 5 or the gate voltage booster 101 shown in FIG. 16A has a larger circuit scale than the circuit shown in FIG. 23 since it additionally has an inverter, resulting in an increase in substrate chip size, i.e., an increase in cost.

Seventh Embodiment

Figure 19:
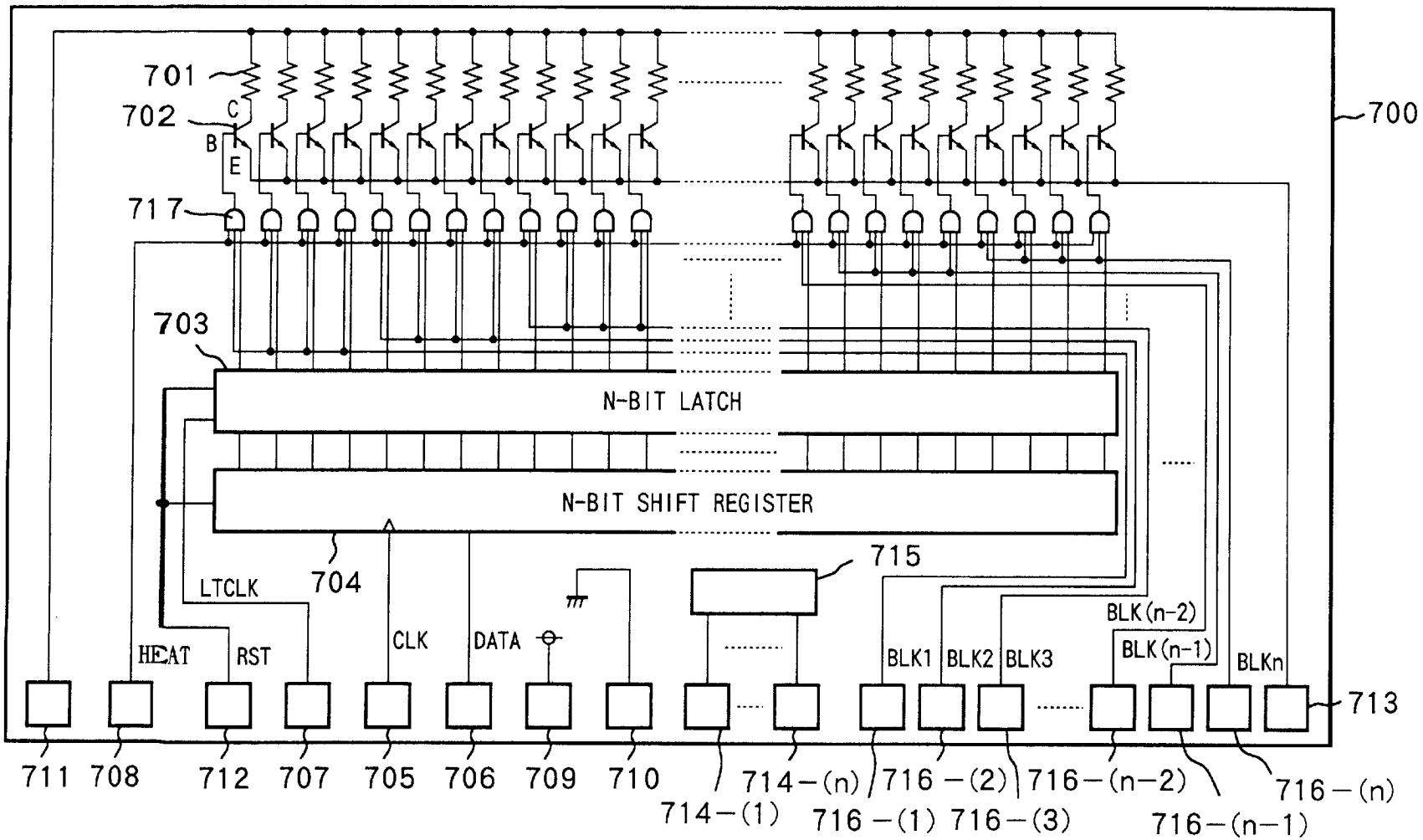
FIG. 19 is a circuit diagram of a conventional ink-jet recording head substrate.
Figure 20A:
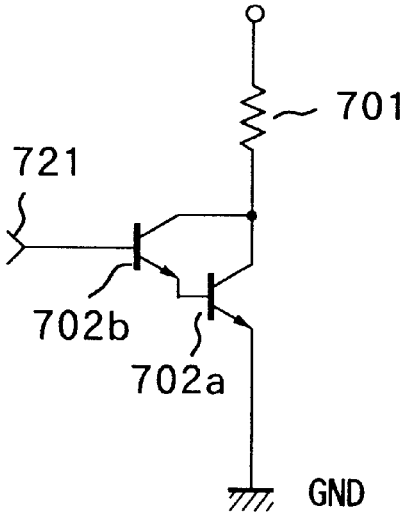
FIG. 20A is a circuit diagram of a conventional driving circuit for a heating element using a bipolar power transistor.
Figure 20B:
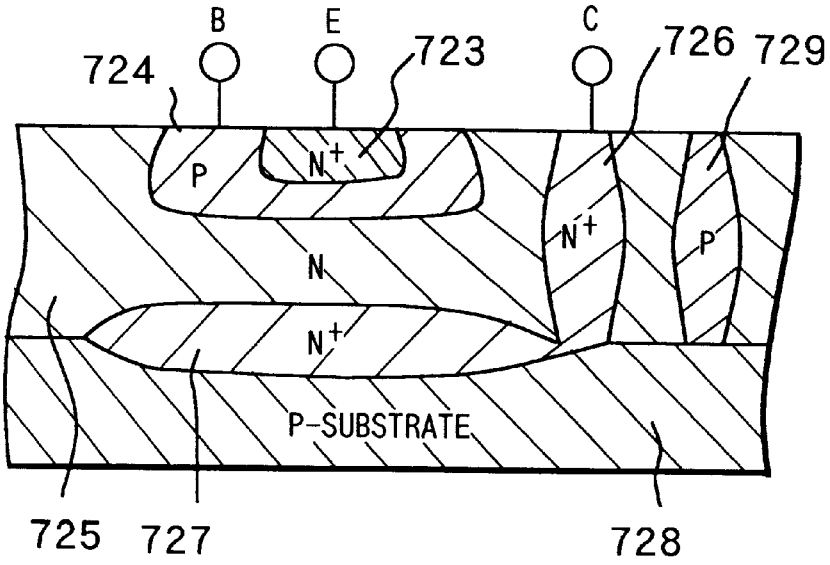
FIG. 20B is a sectional view showing the structure of the bipolar power transistor shown in FIG. 20A.
Figure 24:
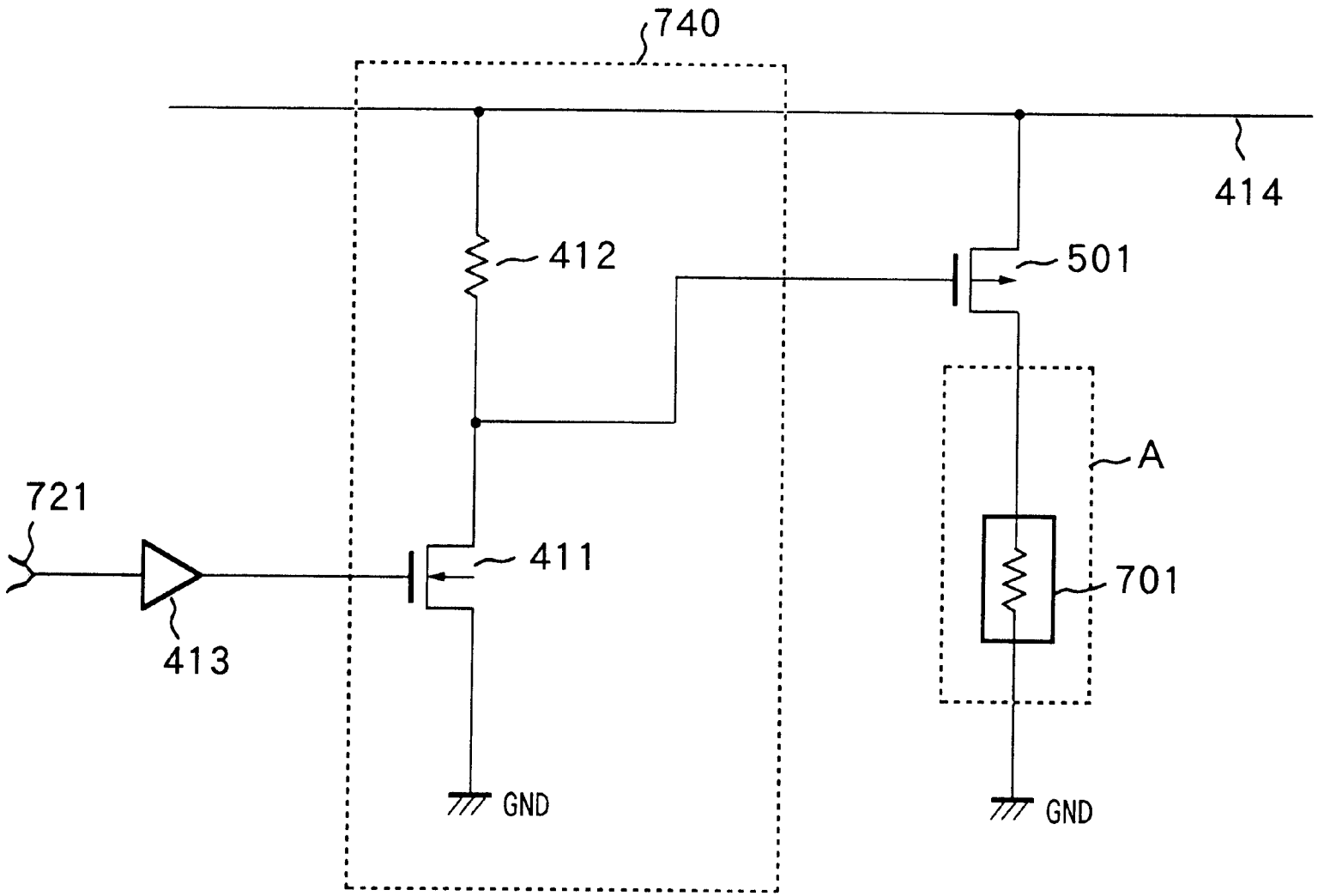
FIG. 24 is a circuit diagram showing the circuit arrangement for driving one print element of a recording head according to the seventh embodiment of the present invention.

FIG. 24 shows the arrangement of a circuit for driving one print element of a recording head. Since the arrangement of the logic circuit of the recording head is the same as that of the conventional logic circuit shown in FIG. 19, a detailed description thereof will be omitted, and such constituting elements will be quoted using the same reference numerals in FIG. 23, as needed. The above-mentioned print element corresponds to a circuit built by a heating element which operates to eject ink from a single orifice, and a power transistor.

Referring to FIG. 24, since a gate voltage booster 740 is an nMOS inverter having the same arrangement as that shown in FIG. 23, the same reference numerals in FIG. 24 denote the same parts as in FIG. 23, and a detailed description thereof will be omitted. A logic output 721 shown in FIG. 24 expresses its ON/OFF state by a voltage of 5 V. Reference numeral 501 denotes a pMOS transistor. Also, a portion A includes a heating element and a wiring portion that face a p-type silicon (Si) substrate and ink via a protection insulating film alone.

In FIG. 24, reference numeral 501 denotes a pMOS transistor which serve s as a power transistor, and drives a heating element 701.

Figure 25A:
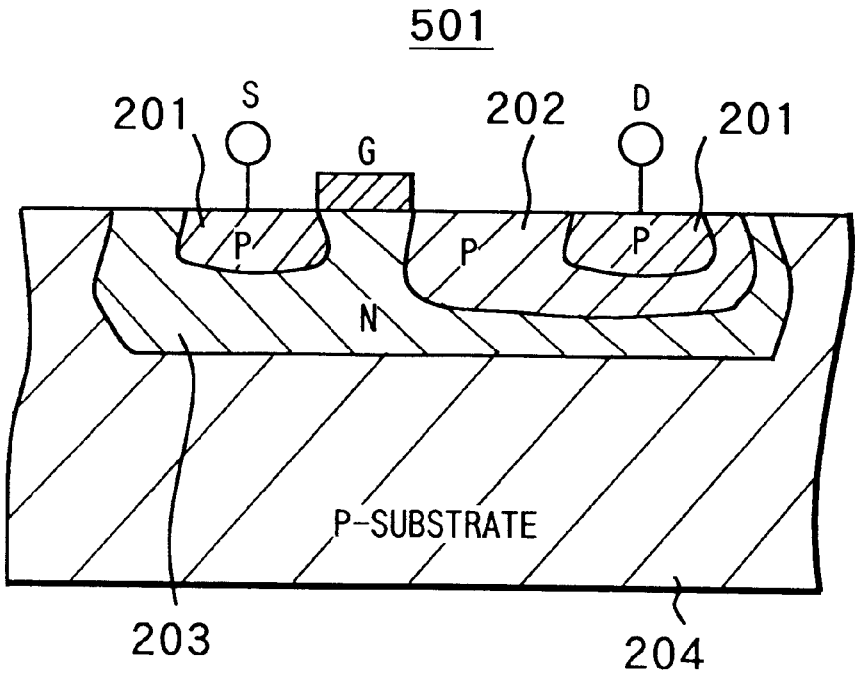
FIG. 25A is a sectional view of a pMOS power transistor shown in FIG. 24.
Figure 25B:
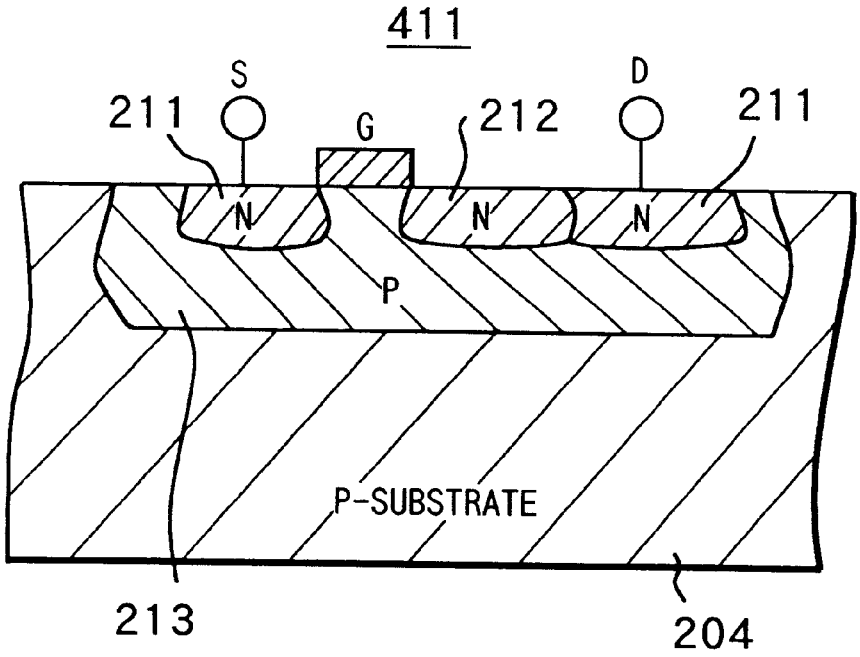
FIG. 25B is a sectional view showing an nMOS transistor in a gate voltage booster shown in FIG. 24.

FIGS. 25A and 25B are sectional views of a substrate in which the pMOS transistor 501, and an nMOS transistor 411 of the gate voltage booster 740 are formed. FIG. 25A shows the arrangement of the pMOS transistor 501, and FIG. 25B shows the arrangement of the nMOS transistor 411.

As shown in FIG. 25A, the pMOS transistor 501 has a structure (offset MOS) in which a $p^-$-type impurity layer 202 is formed between a $p^+$-type impurity layer 201 serving as the drain (D), and the gate (G), so as to raise its breakdown voltage beyond 25 V from that (about 10 to 14 V) of a normal pMOS transistor having no offset structure.

On the other hand, as shown in FIG. 25B, the nMOS transistor 411 has a structure (offset MOS) in which an $n^-$-type impurity layer 212 is formed between an $n^+$-type impurity layer 211 serving as the drain (D), and the gate (G), so as to similarly raise its breakdown voltage as in the above-mentioned pMOS transistor. Note that this structure is the same as that of the offset nMOS transistor shown in FIG. 21B.

In FIGS. 25A and 25B, reference numeral 203 denotes an n-type region; and 204, a p-type silicon (Si) substrate.

The operation of the print element and the gate voltage booster 740 of the recording head with the above arrangement will be explained below.

When the pMOS transistor 501 as a power transistor is OFF, i.e., it does not drive the heating element 701, the nMOS transistor 411 is also in the OFF state, and no current is supplied to the gate voltage booster 740. That is, when no printing is done, the consumption power becomes zero. On the other hand, since the nMOS transistor 411 has the offset MOS structure, i.e., has high-breakdown voltage characteristics, a power supply voltage VH on a power supply line 414 is directly applied to an inverter (nMOS transistor 411).

As has been described above, since ink has conductivity, and contacts the p-type silicon (Si) substrate as GND on the side of the substrate, the entire ink serves as GND. On the other hand, when the pMOS transistor 501 is OFF, the heating element and the wiring portion, indicated by the portion A in FIG. 24, which contact the ink via the protection insulating film alone serve as GND. Hence, no electric field is generated between the ink and the portion A via the protection insulating film.

Therefore, according to the above-mentioned embodiment, since no current is supplied to the gate voltage booster 740 when no printing is desired, the consumption power of the recording head in the non-printing state can be reduced. Also, since the gate voltage booster can have a simple arrangement, the number of elements of the overall circuit can be reduced. In this manner, a reduction of the circuit scale of the recording head and a reduction of manufacturing cost can be realized.

For example, as compared to the circuit arrangement shown in FIG. 16A, the number of elements of the gate voltage booster per print element can be halved. When the power switch of the recording apparatus is turned on to perform printing, the print period in which the recording head performs printing is about 200 $\mu$s, while the actual energization time of each heating element is about 3 to 7 $\mu$s, and no printing is performed during most of the print period, i.e., each power transistor is OFF. Since the gate voltage booster 740 does not consume any electric power in such idling state during the print period, the effect of this embodiment is remarkable in terms of a reduction of consumption power.

Furthermore, in the above embodiment, since a pMOS transistor is used as a power transistor, the impact ionization phenomenon that generates ions upon collision of carriers is harder to occur than the nMOS transistor, and production of a leakage current in the drain-source path upon turning off the driven heating element can be suppressed. In this manner, the reliability of the recording head can be improved.

Moreover, in the above embodiment, when the power transistor is OFF, no electric field is generated between the ink and the substrate surface and, hence, the load acting on the protection insulating film can be reduced. Thus, the service life of the substrate can be prolonged, and the reliability of the recording head can also be improved.

In the above embodiment, the inverter at the input side of the pMOS transistor 501 is built by a resistor and an nMOS transistor. However, the present invention is not limited to such specific arrangement. For example, the inverter may be built by an nMOS transistor.

Furthermore, in the above embodiment, both the pMOS transistor as the power transistor, and the nMOS transistor of the gate voltage booster have the offset MOS transistor structure. However, the present invention is not limited to such specific structure. For example, when these MOS transistor can withstand the heating element driving voltage without using an offset structure, one or both of these transistor need not have an offset structure.

In the above embodiment, an ink-jet recording head has been exemplified. However, the present invention is not limited to such head. For example, the present invention can be applied to a thermal head that attains printing by a thermal transfer method.

The above embodiment can achieve high-density, high-definition printing using a system, which comprises means (e.g., an electro-thermal conversion element, laser beam, and the like) for generating heat energy as energy utilized upon ejecting ink, and causes changes in state of ink by the heat energy, among the ink-jet printing systems.

As the representative arrangement and principle of such ink-jet printing system, one practiced by use of the basic principle disclosed in, for example, U.S. Pat. Nos. 4,723,129 and 4,740,796 is preferred. The above system is applicable to either one of so-called on-demand type and continuous type. Particularly, in the case of the on-demand type, the system is effective because, by applying at least one driving signal, which corresponds to printing information and gives a rapid temperature rise exceeding film boiling, to each of electro-thermal conversion elements arranged in correspondence with a sheet or liquid channels holding liquid (ink), heat energy is generated by the electro-thermal conversion element to effect film boiling on the heat acting surface of the recording head, and consequently, a bubble can be formed in the liquid (ink) in one-to-one correspondence with the driving signal. By ejecting the liquid (ink) through an ejection opening by growth and shrinkage of the bubble, at least one droplet is formed. If the driving signal is applied as a pulse signal, the growth and shrinkage of the bubble can be attained instantly and adequately to achieve ejection of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the recording head, in addition to the arrangement as a combination of orifices, liquid channels, and electro-thermal conversion elements (linear liquid channels or right-angled liquid channels) as disclosed in the above specifications, the arrangement using U.S. Pat. Nos. 4,558,333 and 4,459,600, which disclose an arrangement having a heat acting portion arranged in a bent region may be used. In addition, an arrangement based on Japanese Patent Laid-Open No. 59-123670 which discloses an arrangement using a slit common to a plurality of electro-thermal conversion elements as an ejection portion of the electro-thermal conversion elements, or Japanese Patent Laid-Open No. 59-138461 which discloses an arrangement having an opening for absorbing a pressure wave of heat energy in correspondence with an ejection portion, may be used.

Furthermore, as a full line type recording head having a length corresponding to the width of a maximum print medium which can be printed by the recording apparatus, either the arrangement which satisfies the full-line length by combining a plurality of recording heads as disclosed in the above specification or the arrangement as a single recording head obtained by forming recording heads integrally may be used.

In addition, an exchangeable chip type recording head which can be electrically connected to the recording apparatus main body or can receive ink from the recording apparatus main body upon being mounted on the recording apparatus main body may be used in addition to a cartridge type recording head in which an ink tank is integrally arranged on the recording head itself, described in the above embodiment.

It is preferable to add recovery means for the recording head, preliminary means, and the like to the arrangement of the recording apparatus of the present invention since printing can be further stabilized. Examples of such means include, for the recording head, capping means, cleaning means, pressurization or suction means, and preliminary heating means using electro-thermal conversion elements, another heating element, or a combination thereof. It is also effective for stable printing to execute a preliminary ejection mode which performs ejection independently of printing.

Furthermore, as the print mode of the recording apparatus, the recording apparatus may have not only the print mode of only a primary color such as black or the like but also at least one of a multiple-color print mode using a plurality of different colors or a full-color print mode by mixing colors, which modes may be attained by either an integrated recording head or a combining a plurality of recording heads.

Moreover, in the above-mentioned embodiment, ink is described as a liquid. Alternatively, the present invention may use even ink which is solid at room temperature or less, and ink which softens or liquefies at room temperature. Alternatively, since it is a common practice in the ink-jet method to perform temperature control of the ink itself within the range from 30° C. to 70° C. so that the ink viscosity falls within the stable ejection range, any types of ink may be used as long as they liquefy upon application of a use print signal.

In addition, in order to prevent a temperature rise caused by heat energy by positively utilizing it as energy for causing changes in state of the ink from the solid state to the liquid state, or to prevent evaporation of the ink, ink which is solid in a non-use state and liquefies upon heating may be used. In any case, the present invention can be applied to a case wherein ink which liquefies upon application of heat energy, such as ink which liquefies upon application of heat energy according to a print signal and is ejected in the liquid state, ink which begins to solidify when it reaches a print medium, or the like, is used. In the present invention, the above-mentioned film boiling system is most effective for the above-mentioned inks.

Also, the recording apparatus of the present invention may be arranged integrally or separately as the image output terminal of information processing equipment such as a computer or the like, or may be used in a copying machine combined with a reader and the like, and a facsimile apparatus having a transmission/reception function.

Note that the present invention may be applied to either a system built by a plurality of devices (e.g., a host computer, interface device, reader, recording apparatus, and the like), or an apparatus (such as a copying machine, facsimile apparatus, or the like) consisting of a single device.

In the above description, the ink-jet recording head substrate is used in an ink-jet recording head. The substrate structure based on the present invention can also be applied to, e.g., a thermal head substrate.

Effect

As described above, according to the present invention, upon driving a heater by inputting a latch output corresponding to a digital signal that expresses OFF and ON using, e.g., 0 V and 5 V, to a power transistor such as a FET, the latch output can be boosted, and the boosted output can be applied to the power transistor. For this reason, the drivability of the power transistor such as a FET can be improved, and a recording head with higher performance, and a recording apparatus using the recording head can be realized.

According to the present invention, even when the characteristics of a MOS transistor that drives a heater vary depending on the semiconductor manufacturing process, the variations in characteristics can be corrected by a correction circuit. Accordingly, the recording head can operate stably, and high-quality image printing can be attained.

Furthermore, according to the present invention, since lightly-doped regions are formed on the drains of nMOS and pMOS elements in a CMOS inverter circuit of a recording head substrate to add $p^-$- or $n^-$-type regions to the conventional element structure, a CMOS inverter circuit which comprises a pMOS or nMOS element that can withstand the driving voltage of the heating element can be arranged at the input side of the power transistor without increasing consumption power or without arranging another power supply or any fear of voltage drifts, thus realizing a high-breakdown voltage CMOS inverter circuit for driving the power transistor.

Since the $p^-$-or $n^-$-type layer is added to the pMOS or nMOS element of the CMOS inverter circuit, a diode sensor can have an npnp or pnpn structure to be perfectly isolated from a p- or n-type substrate. Hence, a diode sensor which is free from any influence of a parasitic transistor and is perfectly isolated can be formed at the same time.

Since the diode sensor can be perfectly isolated, a series connection of diode sensors can be realized. An increase in the number of terminals of the sensors can be prevented, and the dynamic range can be accurately broadened by a series connection of diode sensors.

Since a power supply voltage can be commonly supplied from a power supply for driving print elements, no additional power supply is required, and the need for a step-down circuit can be obviated. Also, a punch-through current can be eliminated since the CMOS structure is used. In this manner, since temperature rise of the recording head can be prevented, and energy savings can be attained, the present invention is suitable for a battery-driven recording apparatus, or the like.

Furthermore, since the recording head of the present invention uses the above-mentioned recording head substrate, and the recording apparatus of the present invention mounts the recording head, a reduction of power supply cost and a size reduction of the recording apparatus can be realized.

In addition, according to the present invention, the circuit scale of the recording head can be reduced, and current leakage in the drain-source path of the power transistor for driving the heating element can be suppressed, thereby improving the reliability of the recording head and reducing the consumption power of the recording head.

Moreover, ink contacts the heating element via an electric insulating layer, and is printed upon heating. However, since no electric field is generated between the ink and the heating element via the insulating layer in the non-printing state, the load acting on the insulating layer can be reduced, thus improving the reliability of the recording head and prolonging its service life.

What is claimed is:

1. A recording head comprising:

a heater corresponding to a print element;

a MOS power transistor connected to said heater in electrical series for energizing and driving said heater;

a MOS logic circuit for driving said MOS power transistor; and a voltage converter for converting a voltage amplitude of a signal output from said MOS logic circuit into a higher voltage amplitude, and applying a signal with the converted amplitude to a gate electrode of said MOS power transistor.

2. The recording head according to claim 1, wherein said MOS logic circuit comprises:

a shift register for temporarily storing an input digital image signal; and a latch circuit for latching the digital image signal stored in said shift register, and said voltage converter boosts a voltage that expresses an ON state of the digital signal latched by said latch circuit, and applies the boosted voltage to said MOS power transistor.

3. The recording head according to claim 1, wherein said MOS power transistor comprises an n-type MOSFET.

4. The recording head according to claim 3, wherein said voltage converter is arranged between a gate of said n-type MOSFET and an output terminal of said latch circuit.

5. The recording head according to claim 4, wherein said voltage converter comprises:

a first resistor;

a first nMOS transistor, a drain of which is connected to said first resistor; and a CMOS inverter built by a first pMOS transistor and a second nMOS transistor, gates of which are connected between said first resistor and the drain.

6. The recording head according to claim 5, wherein lightly-doped regions are formed in drains of the first pMOS transistor and the second nMOS transistor of said CMOS inverter circuit.

7. The recording head according to claim 6, wherein a lightly-doped p-type impurity region in the drain of said first pMOS transistor is shallower than an n-type region serving as a pMOS substrate of said CMOS inverter circuit, and is deeper than a heavily-doped n-type impurity region serving as a drain and source of said second nMOS transistor of said CMOS inverter circuit.

8. The recording head according to claim 7, wherein a temperature sensor is formed as a diode having an npnp structure made up of the heavily-doped n-type impurity region serving as the drain and source of said second nMOS transistor, the lightly-doped p-type impurity region in the drain of said first pMOS transistor, and the n-type region and a p-type substrate serving as the pMOS substrate of said CMOS inverter circuit, so as to use the heavily-doped n-type impurity region as a cathode and the lightly-doped p-type impurity region as an anode.

9. The recording head according to claim 6, wherein said recording head is an ink-jet recording head that attains printing by ejecting ink.

10. The recording head according to claim 6, wherein said recording head is a recording head that ejects ink using heat energy, and comprises a heat energy conversion element for generating heat energy that is applied to the ink.

11. A recording apparatus comprising the recording head of claim 6.

12. The recording apparatus according to claim 11, wherein said MOS power transistor comprises an n-type MOSFET.

13. The recording apparatus according to claim 12, wherein said voltage converter is arranged between a gate of said n-type MOSFET and an output terminal of said latch circuit.

14. The recording apparatus according to claim 13, wherein said voltage converter comprises:

a first resistor;

a first nMOS transistor, a drain of which is connected to said first resistor; and a CMOS inverter built by a first pMOS transistor and a second nMOS transistor, gates of which are connected between said first resistor and the drain.

15. The recording apparatus according to claim 11, further comprising a carriage for carrying the recording head.

16. The recording head according to claim 5, wherein said MOS power transistor comprises a pMOS transistor, and lightly-doped regions are formed in drains of the first pMOS transistor and the second nMOS transistor of said CMOS inverter circuit.

17. The recording head according to claim 16, wherein a lightly-doped n-type impurity region in the drain of said second nMOS transistor is shallower than a p-type region serving as an nMOS substrate of said CMOS inverter circuit, and is deeper than a heavily-doped p-type impurity region serving as a drain and source of said first pMOS transistor of said CMOS inverter circuit.

18. The recording head according to claim 17, wherein a temperature sensor is formed as a diode having a pnpn structure made up of the heavily-doped p-type impurity region serving as the drain and source of said first pMOS transistor, the lightly-doped n-type impurity region in the drain of said second nMOS transistor, and the p-type region and an n-type substrate serving as the nMOS substrate of said CMOS inverter circuit, so as to use the heavily-doped p-type impurity region as an anode and the lightly-doped n-type impurity region as a cathode.

19. The recording head according to claim 16, wherein said recording head is an ink-jet recording head that attains printing by ejecting ink.

20. The recording head according to claim 16, wherein said recording head is a recording head that ejects ink using heat energy, and comprises a heat energy conversion element for generating heat energy that is applied to the ink.

21. A recording apparatus comprising the recording head of claim 16.

22. The recording apparatus according to claim 21, wherein said MOS power transistor comprises an n-type MOSFET.

23. The recording apparatus according to claim 22, wherein said voltage converter is arranged between a gate of said n-type MOSFET and an output terminal of said latch circuit.

24. The recording apparatus according to claim 23, wherein said voltage converter comprises:

a first resistor;

a first nMOS transistor, a drain of which is connected to said first resistor; and a CMOS inverter built by a first pMOS transistor and a second nMOS transistor, gates of which are connected between said first resistor and the drain.

25. The recording apparatus according to claim 21, further comprising a carriage for carrying the recording head.

26. The recording head according to claim 1, further comprising:

a first power supply line for applying a first voltage to said heater; and a second power supply line for applying a second voltage to said voltage converter.

27. The recording head according to claim 26, further comprising:

a voltage-dividing circuit for generating the second power supply voltage by voltage-dividing the first power supply voltage, and wherein a common power supply is used for the first and second power supply voltages.

28. The recording head according to claim 27, wherein said voltage-dividing circuit includes a source-follower circuit.

29. The recording head according to claim 1, wherein said recording head is an ink-jet head that attains printing by ejecting ink.

30. A recording apparatus using a recording head of claim 1.

31. The recording head according to claim 1, further comprising:

a correction circuit for correcting a characteristic variation of said MOS power transistor.

32. The recording head according to claim 31, wherein causes of the characteristic variation include a variation in gate length of said MOS power transistor in a semiconductor manufacturing process.

33. The recording head according to claim 32, wherein said correction circuit suppresses a drift of a drain current of said MOS power transistor by controlling a gate voltage of said MOS power transistor to compensate for the characteristic variation owing to the variation in gate length.

34. The recording head according to claim 33, wherein said correction circuit lowers the gate voltage when the gate length becomes smaller than a design value due to the variation in the semiconductor manufacturing process, and raises the gate voltage when the gate length becomes larger than the design value.

35. The recording head according to claim 34, wherein said correction circuit includes a second resistor and a third nMOS transistor connected to said second resistor.

36. The recording head according to claim 35, wherein said second resistor comprises a polysilicon resistor.

37. The recording head according to claim 36, further comprising:

a source-follower circuit built by a fourth nMOS transistor, and a third resistor connected between a source of said fourth nMOS transistor and ground, and wherein a drain of said fourth nMOS transistor is connected to the first power supply line, a node between the other terminal of said second resistor and the drain of said third nMOS transistor is connected to a gate of said fourth nMOS transistor, and a node between the source of said fourth nMOS transistor and said third resistor is connected to the second power supply line.

38. The recording head according to claim 35, wherein one terminal of said second resistor is connected to a first power supply line, a node between the other terminal of said second resistor and a drain of said third nMOS transistor is connected to a second power supply line, and a source of said third nMOS transistor is connected to ground.

39. The recording head according to claim 31, wherein said MOS logic circuit and said voltage converter are circuits formed by a CMOS process.

40. The recording head according to claim 11, wherein said MOS logic circuit and said voltage converter are circuits formed by an nMOS process.

41. The recording head according to claim 31, wherein said recording head is an ink-jet recording head that attains printing by ejecting ink.

42. The recording head according to claim 31, wherein said recording head is a recording head that ejects ink using heat energy, and comprises a heat energy conversion element for generating heat energy that is applied to the ink.

43. A recording apparatus comprising the recording head of claim 31.

44. The recording apparatus according to claim 43, wherein said MOS power transistor comprises an n-type MOSFET.

45. The recording apparatus according to claim 44, wherein said voltage converter is arranged between a gate of said n-type MOSFET and an output terminal of said latch circuit.

46. The recording apparatus according to claim 45, wherein said voltage converter comprises:

a first resistor;

a first nMOS transistor, a drain of which is connected to said first resistor; and a CMOS inverter built by a first pMOS transistor and a second nMOS transistor, gates of which are connected between said first resistor and the drain.

47. The recording apparatus according to claim 43, further comprising a carriage for carrying the recording head.

48. The recording head according to claim 1, wherein said MOS power transistor comprises a pMOS transistor, and said voltage converter has an inverter including at least one nMOS transistor, which boosts a voltage that is applied by receiving a print signal output from said MOS logic circuit, and outputs the boosted voltage to a gate of said pMOS transistor, and said pMOS transistor and said heater are serially connected between a power supply line of said heater and ground in turn from the power supply line side.

49. The recording head according to claim 48, wherein said pMOS transistor and nMOS transistor are offset type transistors.

50. The recording head according to claim 48, wherein said pMOS transistor and nMOS transistor are driven by a voltage on the predetermined power supply line.

51. The recording head according to claim 48, wherein said heater, said pMOS transistor, and said nMOS transistor are formed on a p-type silicon substrate.

52. The recording head according to claim 48, wherein said voltage converter includes a resistor connected between said nMOS transistor and the power supply line.

53. The recording head according to claim 48, wherein said recording head is an ink-jet recording head that attains printing by ejecting ink.

54. The recording head according to claim 53, wherein the ink contacts said heater via an electric insulating film, and is heated by said heater upon printing.

55. A recording apparatus comprising the recording head of claim 48.

56. The recording apparatus according to claim 55, wherein said MOS power transistor comprises an n-type MOSFET.

57. The recording apparatus according to claim 56, wherein said voltage converter is arranged between a gate of said n-type MOSFET and an output terminal of said latch circuit.

58. The recording apparatus according to claim 57, wherein said voltage converter comprises:

a first resistor;

a first nMOS transistor, a drain of which is connected to said first resistor; and a CMOS inverter built by a first pMOS transistor and a second nMOS transistor, gates of which are connected between said first resistor and the drain.

59. The recording apparatus according to claim 55, further comprising a carriage for carrying the recording head.

60. An ink-jet head cartridge comprising the recording head of claim 1 and an ink tank.

61. The ink-jet head cartridge according to claim 60, wherein said MOS power transistor comprises an n-type MOSFET.

62. The ink-jet head cartridge according to claim 61, wherein said voltage converter is arranged between a gate of said n-type MOSFET and an output terminal of said latch circuit.

63. The ink-jet head cartridge according to claim 62, wherein said voltage converter comprises:

a first resistor;

a first nMOS transistor, a drain of which is connected to said first resistor; and a CMOS inverter built by a first pMOS transistor and a second nMOS transistor, gates of which are connected between said first resistor and the drain.

64. The recording head according to claim 1, further comprising a carriage for carrying the recording head.

65. The ink-jet head cartridge according to claim 60, further comprising a carriage for carrying the recording head.

66. A substrate for driving a recording head, said substrate comprising:

a heater corresponding to a print element;

a MOS power transistor connected to said heater in electrical series for energizing and driving said heater;

a MOS logic circuit for driving said MOS power transistor; and a voltage converter for converting a voltage amplitude of a signal output from said MOS logic circuit into a higher voltage amplitude, and applying a signal with the converted amplitude to a gate electrode of said MOS power transistor.

67. The substrate according to claim 66, wherein said MOS power transistor comprises an n-type MOSFET.

68. The substrate according to claim 67, wherein said voltage converter is arranged between a gate of said n-type MOSFET and an output terminal of said latch circuit.

69. The substrate according to claim 68, wherein said voltage converter comprises:

a first resistor;

a first nMOS transistor, a drain of which is connected to said first resistor; and a CMOS inverter built by a first pMOS transistor and a second nMOS transistor, gates of which are connected between said first resistor and the drain.

70. The substrate according to claim 66, further comprising a carriage for carrying the recording head.

71. A recording head comprising a substrate, said substrate comprising:

a heater corresponding to a print element;

a MOS power transistor connected to said heater in electrical series for energizing and driving said heater;

a MOS logic circuit for driving said MOS power transistor; and a voltage converter for converting a voltage amplitude of a signal output from said MOS logic circuit into a higher voltage amplitude, and applying a signal with the converted amplitude to a gate electrode of said MOS power transistor.

* * * * *

UNITED STATES PATENT AND TRADEMARK OFFICE

CERTIFICATE OF CORRECTION

PATENT NO. : 6,302,504 B1 
DATED : October 16, 2001
INVENTOR(S) : Yoshiyuki Imanaka et al.

It is certified that error appears in the above-identified patent and that said Letters Patent is hereby corrected as shown below:

Column 1,
Line 62, “line 451” should read -- line 452 --.

Column 3,
Line 67, “22D.” should read -- 20B. --.

Column 4,
Line 42, “$n^{31}$ -type” should read -- $n^{-}$-type --.

Column 6,
Line 21, “header” should read -- heater --.

Column 17,
Line 47, “drift” should read -- differ --.

Column 18,
Line 19, “described” should read -- been described --.

Column 24,
Lines 51 and 53, “transistor” should read -- transistors --;

Column 26,
Line 7, “a combining” should read -- by combining --.

Column 30,
Line 47, “claim 11,” should read -- claim 31, --

UNITED STATES PATENT AND TRADEMARK OFFICE

CERTIFICATE OF CORRECTION

PATENT NO. : 6,302,504 B1 
DATED : October 16, 2001
INVENTOR(S) : Yoshiyuki Imanaka et al.

It is certified that error appears in the above-identified patent and that said Letters Patent is hereby corrected as shown below:

Column 32,
Line 14, “head” should read -- apparatus --; and “claim 1,” should read -- claim 30, --.

Signed and Sealed this

Second Day of July, 2002

*Attest:*

*Attesting Officer*

JAMES E. ROGAN
*Director of the United States Patent and Trademark Office*